US008437895B2

(12) United States Patent
Ito

(10) Patent No.: US 8,437,895 B2
(45) Date of Patent: May 7, 2013

(54) MARINE VESSEL CONTROL APPARATUS, MARINE VESSEL PROPULSION SYSTEM, AND MARINE VESSEL

(75) Inventor: Makoto Ito, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 507 days.

(21) Appl. No.: 12/748,517

(22) Filed: Mar. 29, 2010

(65) Prior Publication Data

US 2010/0256844 A1 Oct. 7, 2010

(30) Foreign Application Priority Data

Apr. 6, 2009 (JP) ..... 2009-092126

(51) Int. Cl.
*G06F 7/00* (2006.01)

(52) U.S. Cl.
USPC ..... 701/21; 701/36; 701/102; 701/113; 440/85

(58) Field of Classification Search ..... 701/21, 701/36, 51, 101, 102, 113, 114, 115; 440/84, 440/85
See application file for complete search history.

(56) References Cited

U.S. PATENT DOCUMENTS 6,595,811 B2 * 7/2003 Dagenais et al. ..... 440/1
7,144,283 B2 * 12/2006 Kawase ..... 440/84
7,349,479 B2 * 3/2008 Suganuma et al. ..... 375/257
7,442,101 B2 * 10/2008 Kawase et al. ..... 440/1
7,957,891 B2 * 6/2011 Okuyama et al. ..... 701/115
2004/0121666 A1 6/2004 Okuyama
2006/0089060 A1 4/2006 Kawase et al.
2007/0082566 A1 4/2007 Okuyama
2007/0227489 A1 10/2007 Ando

FOREIGN PATENT DOCUMENTS

JP 2004-052697 A 2/2004
JP 2006-117163 A 5/2006
JP 2007-002812 A 1/2007
JP 2007-028816 A 2/2007
JP 2007-083767 A 4/2007
JP 2007-263060 A 10/2007

* cited by examiner

*Primary Examiner* — Richard M. Camby
(74) *Attorney, Agent, or Firm* — Keating & Bennett, LLP

(57) ABSTRACT

A marine vessel control apparatus is arranged and programmed to control a propulsion device including an engine and a propulsion device control unit. The marine vessel control apparatus includes a starter switch arranged to be operated by an operator to start the engine, and a main control unit arranged and programmed to receive a start command from the starter switch and to communicate with the propulsion device control unit. The main control unit includes a stand-by unit arranged to, when receiving the start command from the starter switch, stand by until information for determination of a predetermined start permission condition is acquired from the propulsion device control unit, a determining unit arranged to, after the information is acquired, determine if the start permission condition is met, and an engine start command unit arranged to, if the start permission condition is met, provide an engine start command to the propulsion device control unit.

16 Claims, 12 Drawing Sheets

MARINE VESSEL CONTROL APPARATUS, MARINE VESSEL PROPULSION SYSTEM, AND MARINE VESSEL

BACKGROUND OF THE INVENTION

1. Field of the Invention

The present invention relates to a marine vessel control apparatus for controlling propulsion devices having engines, and to a marine vessel propulsion system and a marine vessel using such an apparatus.

2. Description of the Related Art

One example of a marine vessel propulsion device is an outboard motor. The outboard motor is mounted at the stern of a hull, for example. The outboard motor can generate a propulsive force by rotating a propeller with a driving force from an engine. Multiple outboard motors may be mounted on the hull depending on how large a propulsive force is required. Each outboard motor includes an outboard motor ECU (Electronic Control Unit) for engine output control.

A steering apparatus and a remote control apparatus for output control of each outboard motor is provided around the operator's seat in the marine vessel. The steering apparatus includes a steering mechanism, for example. The operation of the steering mechanism can be transmitted to each outboard motor through a cable so that the direction of each outboard motor is changed. The remote control apparatus includes levers for shift position selection and engine output control of the respective outboard motors. The shift position and engine speed of each outboard motor can be controlled according to the operational position of the corresponding lever. More specifically, the operational positions of the levers are input to remote control ECUs, and a target shift position and a target engine speed are provided from each remote control ECU to the corresponding outboard motor ECU.

The shift position includes a forward drive position, a neutral position, and a reverse drive position. When the forward drive position is selected, the propeller rotates in a direction to provide a propulsive force in the forward drive direction of the marine vessel. When the reverse drive position is selected, the propeller rotates in a direction to provide a propulsive force in the reverse drive direction of the marine vessel. When the neutral position is selected, no engine output is transmitted to the propeller.

The marine vessel includes a local area network (inboard LAN) built therein. The inboard LAN is connected with the remote control ECUs and outboard motor ECUs to provide data communications therebetween.

One battery is provided for each outboard motor or to commonly supply electricity to all of the multiple outboard motors. The battery supplies power to a starter motor for starting the engine, each outboard motor ECU, and each remote control ECU. A power switch arranged to switch between power supply and shutdown from the battery to the outboard motors is further provided around the operator's seat. Multiple power switches may be provided for the respective outboard motors (see United States Patent Application Publication No. US 2006/0089060A1). Each power switch is in a form of a key switch, for example, and also acts as a starter switch for starting the corresponding engine. More specifically, when the key switch is operated from the OFF to ON position, power is supplied from the battery to the outboard motor. When the key switch is further operated from the ON to START position, the starter is activated to start a cranking operation.

SUMMARY OF THE INVENTION

The inventors of preferred embodiments of the present invention described and claimed in the present application conducted an extensive study and research regarding a marine vessel control apparatus, such as the one described above, and in doing so, discovered and first recognized new unique challenges and previously unrecognized possibilities for improvements as described in greater detail below.

At the start of an engine, it is preferable to determine if a predetermined start permission condition is met. The start permission condition may include that the shift position selected on the remote control apparatus (target shift position) is in a neutral position, that the actual shift position of the outboard motor is also in a neutral position, and that the engine is stopped.

The determination of the start permission condition can be made in the corresponding remote control ECU, for example. The determination of the start permission condition in the remote control ECU is to be made in response to a start command from the corresponding starter switch. In this case, the remote control ECU determines if the remote control lever is in a neutral position (i.e., the target shift position is in a neutral position). The remote control ECU also receives information about the actual shift position of the outboard motor from the corresponding outboard motor ECU through inter-ECU communications to determine if the actual shift position is also in a neutral position. The remote control ECU further receives information about the engine speed from the outboard motor ECU through inter-ECU communications to determine based on the information if the engine is stopped.

After the remote control ECU and outboard motor ECU are powered on, a certain period of time is required before the inter-ECU communications become available. Therefore, if a start command is provided immediately after power-on, a situation can occur in which the remote control ECU cannot make a correct determination of the actual shift position or the engine stop. This is for the reason that there may be a case where the remote control ECU cannot receive necessary information from the outboard motor ECU. For example, even if the remote control ECU may determine, based on shift position information received preliminarily from the outboard motor ECU, that the start permission condition is met, the actual shift position of the outboard motor may not be in the neutral position. In this case, the propeller is to be driven at the start of the engine, resulting in an excessive starting load. This may also result in that the engine cannot be started reliably. In this case, the user is required to repeat the starting operation.

In order to overcome the previously unrecognized and unsolved challenges described above, a preferred embodiment of the present invention provides a marine vessel control apparatus arranged and programmed to control a propulsion device including an engine and a propulsion device control unit. The marine vessel control apparatus includes a starter switch arranged to be operated by an operator to start the engine, and a main control unit arranged and programmed to receive a start command from the starter switch and to communicate with the propulsion device control unit. The main control unit includes a stand-by unit arranged to, when receiving the start command from the starter switch, stand by until information for determination of a predetermined start permission condition is acquired from the propulsion device control unit, a determining unit arranged to, after the information is acquired, determine if the start permission condition is met, and an engine start command unit arranged to, if the start permission condition is met, provide an engine start command to the propulsion device control unit.

In accordance with the arrangement above, when the starter switch is operated, a start command is issued and input to the main control unit. The main control unit receives the start command and determines if information necessary for determination of a predetermined start permission condition has already been acquired. If the information has not yet been acquired, the main control unit stands by until the information is acquired. Once the information necessary for determination of the start permission condition has been acquired, the main control unit then determines if the start permission condition is met. If the start permission condition is met, the main control unit provides an engine start command to the propulsion device control unit. The propulsion device control unit receives the command to start the engine in the propulsion device.

Thus, if the information necessary for determination of the start permission condition has not yet been acquired, the starting process is suspended until the information is acquired. This allows the determination of whether or not the start permission condition is met to be made correctly. Therefore, even if the starter switch may be operated while the information necessary for determination of the start permission condition has not yet been acquired, the determination of the start permission condition can be made reliably. This allows the engine, if in a startable state, to be started reliably, while if in a state not suitable for starting, to be reliably prohibited from being started. The starting process of the propulsion device can thus be performed appropriately.

The information necessary for determination of the start permission condition in the main control unit may be acquired from the propulsion device control unit through communications, for example. In this case, if the information to be acquired through communications has not yet been acquired, the determination of whether or not the start condition is met is suspended. It is therefore possible to reduce or eliminate the possibility that the determination of the start permission condition cannot be made or can only be made incorrectly due to communications delay.

The start permission condition may include that the engine in the propulsion device is stopped. In this case, the propulsion device control unit may have information about the engine speed and the main control unit may acquire the information about the engine speed from the propulsion device control unit through communications.

The propulsion device may include a clutch mechanism arranged to be switchable between a connected state in which a driving force from the engine is transmitted to a propulsive force generation member (e.g., propeller) and a blocked state in which connection through the driving force transmission path is blocked or disconnected. In this case, the start permission condition may include that the clutch mechanism is in the blocked state.

Further, there may be provided an operation unit arranged to be operated by the user and capable of generating a command signal for putting the clutch mechanism into the connected state or the blocked state, and the main control unit may receive the command signal from the operation unit. In this case, the start permission condition may include that the operation unit outputs a command signal for putting the clutch mechanism into the blocked state.

In a preferred embodiment of the present invention, the marine vessel control apparatus further includes an authentication unit arranged to authenticate an authorized user, in which the stand-by unit is arranged to stand by until the authentication unit succeeds in authentication and information for determination of the start permission condition is acquired from the propulsion device control unit.

In accordance with the arrangement above, the main control unit stands by until the authentication unit succeeds in authentication of an authorized user and information necessary for determination of the start permission condition is acquired, and thereafter determines if the start permission condition is met. Therefore, even if the starter switch may be operated before the completion of the authentication process to provide a start command, the start command cannot be disabled immediately. This can reduce the possibility of a problem that the starter switch is required to be reoperated to start the engine.

The stand-by unit may be arranged to stand by until a predetermined limited time passes after the starter switch is operated.

In accordance with the arrangement above, the stand-by time for acquisition of the information for determination of the start permission condition is limited. If the acquisition of the information necessary for determination of the start permission condition is not completed even after stand-by for the predetermined time, the start command issued by operating the starter switch is to be discarded.

If a user authentication is performed, the stand-by time for acquisition of the information for determination of the start permission condition and for the user authentication is limited. If the acquisition of the information necessary for determination of the start permission condition or the user authentication process is not completed even after stand-by for the predetermined time, the start command issued by operating the starter switch is to be discarded.

Thus, if the acquisition of the information necessary for determination of the start permission condition or the like is not completed for a long period of time, the start command is to be once discarded. It is therefore possible to avoid delay in the engine start in the case where the user authentication may not be completed for an extremely long period of time after the starter switch is operated. This can relieve the discomfort due to delay in the engine start.

The marine vessel control apparatus may be arranged and programmed to control multiple propulsion devices. In this case, the marine vessel control apparatus may further include an authentication unit arranged to perform an authentication process for authentication of an authorized user for all of the propulsion devices. Also, the starter switch may include an all-device start switch arranged to be operated by the operator to collectively start the engines in all of the propulsion devices. Further, the determining unit may be arranged to determine as the start permission condition if an all-device start permission condition is met to collectively start the engines in all of the propulsion devices. Then, the stand-by unit may be arranged to, when receiving an all-device start command from the all-device start switch, stand by until the authentication unit succeeds in authentication for all of the propulsion devices and information for determination of the all-device start permission condition is acquired from the propulsion device control unit.

In accordance with the arrangement above, the main control unit stands by until the authentication unit succeeds in authentication of an authorized user for all of the propulsion devices and information necessary for determination of the all-device start permission condition is acquired, and thereafter determines if the all-device start permission condition is met. Therefore, even if the all-device start switch may be operated before the completion of the authentication process to provide an all-device start command, the all-device start command cannot be disabled immediately. This can reduce the possibility of a problem that the all-device start switch is required to be reoperated to start the engines in all of the propulsion devices.

The all-device start permission condition may include that the engines in all of the propulsion devices are stopped. In this case, the propulsion device control units may have information about the engine speed, and the main control unit may acquire the information about the engine speed from the propulsion device control units in the respective propulsion devices through communications.

The propulsion devices may each include a clutch mechanism switchable between a connected state in which a driving force from the engine is transmitted to a propulsive force generation member (e.g., propeller) and a blocked state in which connection through the driving force transmission path is blocked or disconnected. In this case, the all-device start permission condition may include that the clutch mechanisms in all of the propulsion devices are in the blocked state.

Further, there may be provided an operation unit arranged to be operated by the user and capable of generating a command signal for putting the clutch mechanisms into the connected state or the blocked state, and the main control unit may receive the command signal from the operation unit. In this case, the start permission condition may include that the operation unit outputs a command signal for putting the clutch mechanisms in all of the propulsion devices into the blocked state.

The stand-by unit may be arranged to stand by until a predetermined limited time passes after the all-device start switch is operated.

In accordance with the arrangement above, the stand-by time for acquisition of the information for determination of the all-device start permission condition and for the user authentication for all of the propulsion devices is limited. If the acquisition of the information necessary for determination of the all-device start permission condition or the user authentication process for all of the propulsion devices is not completed even after stand-by for the predetermined time, the all-device start command issued by operating the all-device start switch is to be discarded.

Thus, if the acquisition of the information necessary for determination of the all-device start permission condition or the like is not completed for a long period of time, the all-device start command is to be once discarded. It is therefore possible to avoid delay in the engine start in the case where the user authentication may not be completed for an extremely long period of time after the all-device start switch is operated. This can solve the problems associated with delay in the engine start.

In a preferred embodiment of the present invention, the determining unit is arranged to, if any one of a plurality of predetermined conditions is met before the predetermined time passes, determine as the start permission condition whether a predetermined individual start permission condition is met to individually start the engine in a successfully authenticated one of the propulsion devices. The plurality of predetermined conditions may include that the authentication unit does not succeed in authentication for all of the propulsion devices, that the information for determination of the all-device start permission condition is not acquired from the propulsion device control unit, and that the all-device start permission condition is not met.

In accordance with the arrangement above, after the all-device start switch is operated, even if the authentication may not be completed for some of the propulsion devices within a predetermined period of time or the all-device start permission condition may not be met, the engine in a successfully authenticated one of the propulsion devices can be started if the individual start permission condition is met. This allows the engines in as many propulsion devices as possible to be started, whereby a starting operation maximally reflecting the intentions of the user who operates the all-device start switch can be achieved.

In a preferred embodiment of the present invention, the propulsion device further includes an engine start holding circuit arranged to continue an engine starting operation independently of the operation of the propulsion device control unit for a predetermined period of time after the engine is started. Also, the propulsion device control unit includes a computer programmed to, if the engine start holding circuit continues the engine starting operation immediately after an initialization, perform an engine starting process independently of the engine start command from the main control unit.

If the engine starting apparatus and propulsion device control unit are supplied with power from a shared power source (battery), the voltage supplied to the propulsion device control unit may drop temporarily when the starting apparatus is driven. When the voltage supplied to the propulsion device control unit drops below a predetermined reset voltage, the operation of the computer in the propulsion device control unit stops and, after the voltage returns, a predetermined initialization process will start. This will suspend the starting process under the control of the propulsion device control unit. Hence, in the present preferred embodiment, the engine start holding circuit is arranged to continue an engine starting operation independently of the operation of the propulsion device control unit for a predetermined period of time after the engine is started. This allows the engine to be started reliably, resulting in an improvement in the startability of the propulsion device.

On the other hand, the computer in the propulsion device control unit checks the operating state of the engine start holding circuit immediately after the initialization and, if the circuit continues the engine starting operation, performs an engine starting process independently of the engine start command from the main control unit. This can prevent the propulsion device control unit from interfering with the operation of the engine start holding circuit and thereby prevent the engine starting operation from being suspended.

The engine starting process may include determination of the start permission condition. This can prevent the engine starting process from being continued if inappropriate.

A preferred embodiment of the present invention provides a marine vessel propulsion system including a propulsion device including an engine and a propulsion device control unit, and a marine vessel control apparatus arranged and programmed to control the propulsion device and having the above-described features. With this arrangement, even if the starter switch may be operated while the information necessary for determination of the start permission condition has not yet been acquired, the determination of the start permission condition can be made reliably. The starting process of the propulsion device can thus be performed appropriately.

Another preferred embodiment of the present invention provides a marine vessel including a hull, a propulsion device mounted on the hull and including an engine and a propulsion device control unit, and a marine vessel control apparatus arranged and programmed to control the propulsion device and having the above-described features. With this arrangement, even if the starter switch may be operated while the information necessary for determination of the start permission condition has not yet been acquired, the determination of the start permission condition can be made reliably. The starting process of the propulsion device can thus be performed appropriately.

The propulsion devices may be in any form of outboard motors, inboard and outboard motors (stern drive, i.e., inboard motor/outboard drive), or inboard motors. Outboard motors have an outboard propulsion unit including an engine and a propeller, being accompanied by a steering mechanism for turning the entire propulsion unit horizontally with respect to the hull. Inboard and outboard motors have an inboard engine and an outboard drive unit including a propeller and a steering mechanism. Inboard motors have an inboard engine and a drive unit with a propeller shaft being extended outboard from the drive unit.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
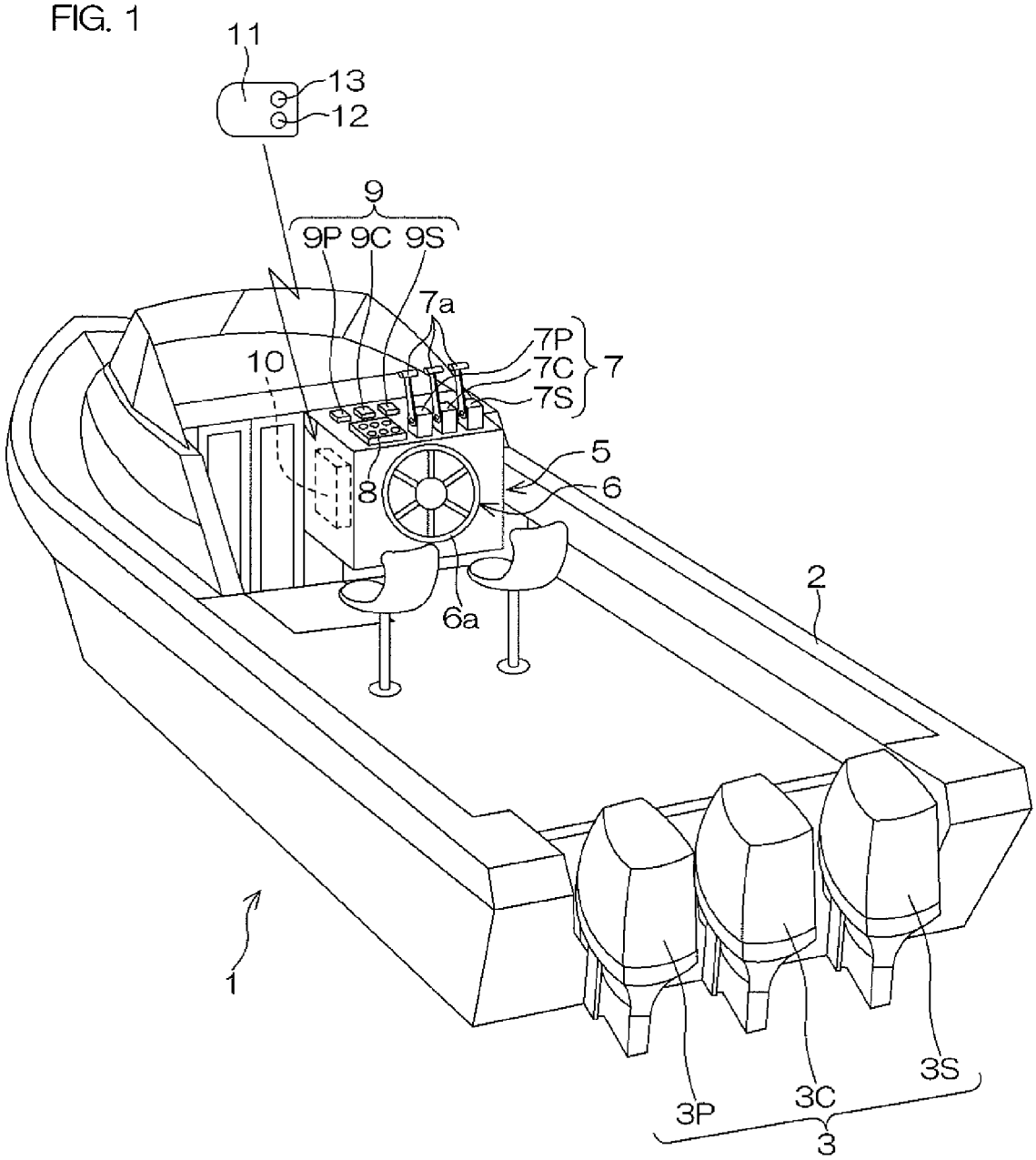
FIG. 1 is a perspective view illustrating the configuration of a marine vessel according to a preferred embodiment of the present invention.

FIG. 1 is a perspective view illustrating the configuration of a marine vessel according to a preferred embodiment of the present invention. The marine vessel 1 includes a hull 2 and multiple outboard motors 3 (for example, three outboard motors in this preferred embodiment) as propulsion devices. These outboard motors 3 are mounted side by side at the stern of the hull 2. The three outboard motors can be distinguished by referring to the starboard side, center, and portside ones, respectively, as "starboard side outboard motor 3S," "center outboard motor 3C," and "portside outboard motor 3P." The outboard motors 3 each include an engine (internal combustion engine), and the propeller (screw) is to be rotated by a driving force from the engine to generate a propulsive force.

An operator's compartment 5 is provided in the front (on the stem side) of the hull 2. The operator's compartment 5 is provided with a steering operation apparatus 6, remote control apparatuses 7, a control panel 8, and gauges 9.

The steering operation apparatus 6 includes a steering wheel 6*a* to be rotated by a marine vessel maneuvering operator. The operation of the steering wheel 6*a* can be transmitted mechanically through a cable (not shown) to a steering mechanism (not shown) provided at the stern. The steering mechanism interlocks the three outboard motors 3 to change their direction. This allows the direction of propulsive forces to change and therefore the heading direction of the marine vessel 1 is changed. It will be appreciated that a power steering apparatus may be adopted including a sensor for detecting the operation angle of the steering wheel 6*a* and an actuator to be driven according to the operation angle detected by the sensor. In this case, there is no mechanical linkage between the steering wheel 6*a* and the steering mechanism. That is, the actuator can be driven by a control signal according to a steering wheel operation and the outboard motors 3 are to be turned by the driving force.

The three remote control apparatuses 7, which are provided correspondingly to the three outboard motors 3, can be distinguished by referring to ones corresponding to the starboard side, center, and portside outboard motors 3S, 3C, and 3P, respectively, as "starboard-side remote control apparatus 7S," "center remote control apparatus 7C," and "portside remote control apparatus 7P." The remote control apparatuses 7 each include a back-and-forth operable lever 7*a*, and the operational position of the lever 7*a* is to be detected. The operation of each outboard motor 3 can be controlled based on the detected operational position. When the lever 7*a* is operated forward by a predetermined amount or more from a predetermined neutral position, the shift position of the corresponding outboard motor 3 is in the forward drive position and a propulsive force in the forward drive direction is generated by the outboard motor 3. When the lever 7*a* is operated backward by a predetermined amount or more from the neutral position, the shift position of the corresponding outboard motor 3 is in the reverse drive position and a propulsive force in the reverse drive direction is generated by the outboard motor 3. When the lever 7*a* is in the neutral position, the shift position of the corresponding outboard motor 3 is in the neutral position and no propulsive force is generated by the outboard motor 3. The output of each outboard motor 3, that is, the target engine speed of the engine provided in the outboard motor 3 can also be changed according to the amount of operation of the lever 7*a*.

The target engine speed keeps an idle speed within the predetermined amount of forward operation (forward drive shift-in position). When the lever 7*a* is operated forward over the forward drive shift-in position, the target engine speed is set such that the larger the amount of operation of the lever, the higher the target engine speed. The target engine speed also keeps an idle speed within the predetermined amount of backward operation (reverse drive shift-in position). When the lever 7*a* is operated backward over the reverse drive shift-in position, the target engine speed is set such that the larger the amount of operation of the lever, the higher the target engine speed.

Figure 2:
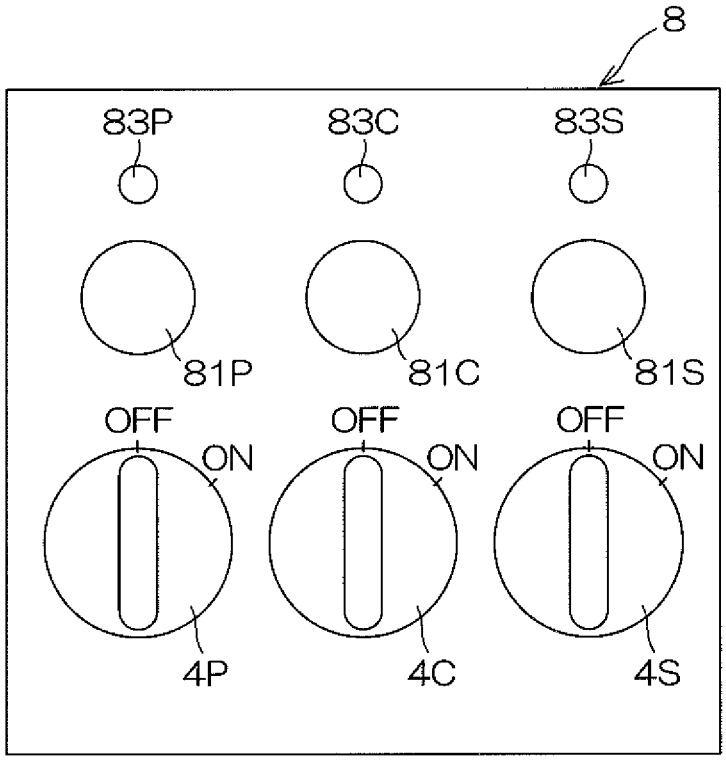
FIG. 2 is a graphical plan view of a control panel.

As shown in an enlarged manner in FIG. 2, the control panel 8 includes three key switches 4S, 4C, and 4P (hereinafter collectively referred to as "key switches 4" when appropriate) provided correspondingly to the three respective outboard motors 3S, 3C, and 3P. The control panel 8 further includes three start/stop switches 81S, 81C, and 81P (hereinafter collectively referred to as "start/stop switches 81" as appropriate) corresponding to the three respective outboard motors 3S, 3C, and 3P. The control panel 8 also includes power indicators 83S, 83C, and 83P provided in the vicinity of the respective start/stop switches 81S, 81C, and 81P.

The key switches 4S, 4C, and 4P are arranged to be operated to power on the respective outboard motors 3S, 3C, and 3P. The key switches 4S, 4C, and 4P are each operable between OFF and ON positions by inserting an associated key in its key cylinder. In the OFF position, the power supply for the corresponding outboard motor 3 is shut off. In the ON position, the corresponding outboard motor 3 is powered on. The power indicators 83S, 83C, and 83P are each formed by, for example, an LED lamp and arranged to turn on when the corresponding outboard motor 3 is powered on, while to turn off when the outboard motor is powered off.

The start/stop switches 81 are arranged to be operated to individually start and stop the engine in the corresponding outboard motor 3, and designed as momentary switches in this preferred embodiment. When a start/stop switch 81 is operated while the engine in the corresponding outboard motor 3 is stopped, a start command for starting the engine is generated. When a start/stop switch 81 is operated while the engine in the corresponding outboard motor 3 operates, a stop command for stopping the engine is generated.

Referring again to FIG. 1, the three gauges 9, which are provided correspondingly to the three outboard motors 3, can be distinguished by referring to ones corresponding to the starboard side, center, and portside outboard motors 3S, 3C, and 3P, respectively, as "starboard-side gauge 9S," "center gauge 9C," and "portside gauge 9P." These gauges 9 are arranged to display the states of the corresponding outboard motors 3. More specifically, they are arranged to display the power-on/off, engine speed, and other necessary information of the corresponding outboard motors 3.

The operator's compartment 5 is further provided with an immobilizer 10 (receiver). The immobilizer 10 is arranged to receive a signal from a key unit 11 carried by a user of the marine vessel 1 and to allow only an authorized user to use the marine vessel 1 normally. The key unit 11 includes a lock button 12 and an unlock button 13. The lock button 12 is arranged to be operated to set the immobilizer 10 to a locked state. When the lock button 12 is operated, a lock signal is sent from the key unit 11. Once the immobilizer 10 is set to a locked state, the normal use of the marine vessel 1 is prohibited. The unlock button 13 is arranged to be operated to release the locked state, set the immobilizer 10 to an unlocked state, and start the normal use of the marine vessel 1. When the unlock button 13 is operated, an unlock signal is sent from the key unit 11. The key unit 11 is also arranged to send a user authentication code together with the lock or unlock signal.

The immobilizer 10 is arranged to receive the user authentication code from the key unit 11 and perform user authentication processing. That is, the immobilizer 10 determines if the received authentication code matches preliminarily registered verification data. If the user authentication processing is completed successfully, the immobilizer 10 accepts the lock or unlock signal from the key unit 11. If the user authentication processing is completed unsuccessfully, the immobilizer 10 responds to neither the lock nor unlock signal from the key unit 11.

Figure 3:
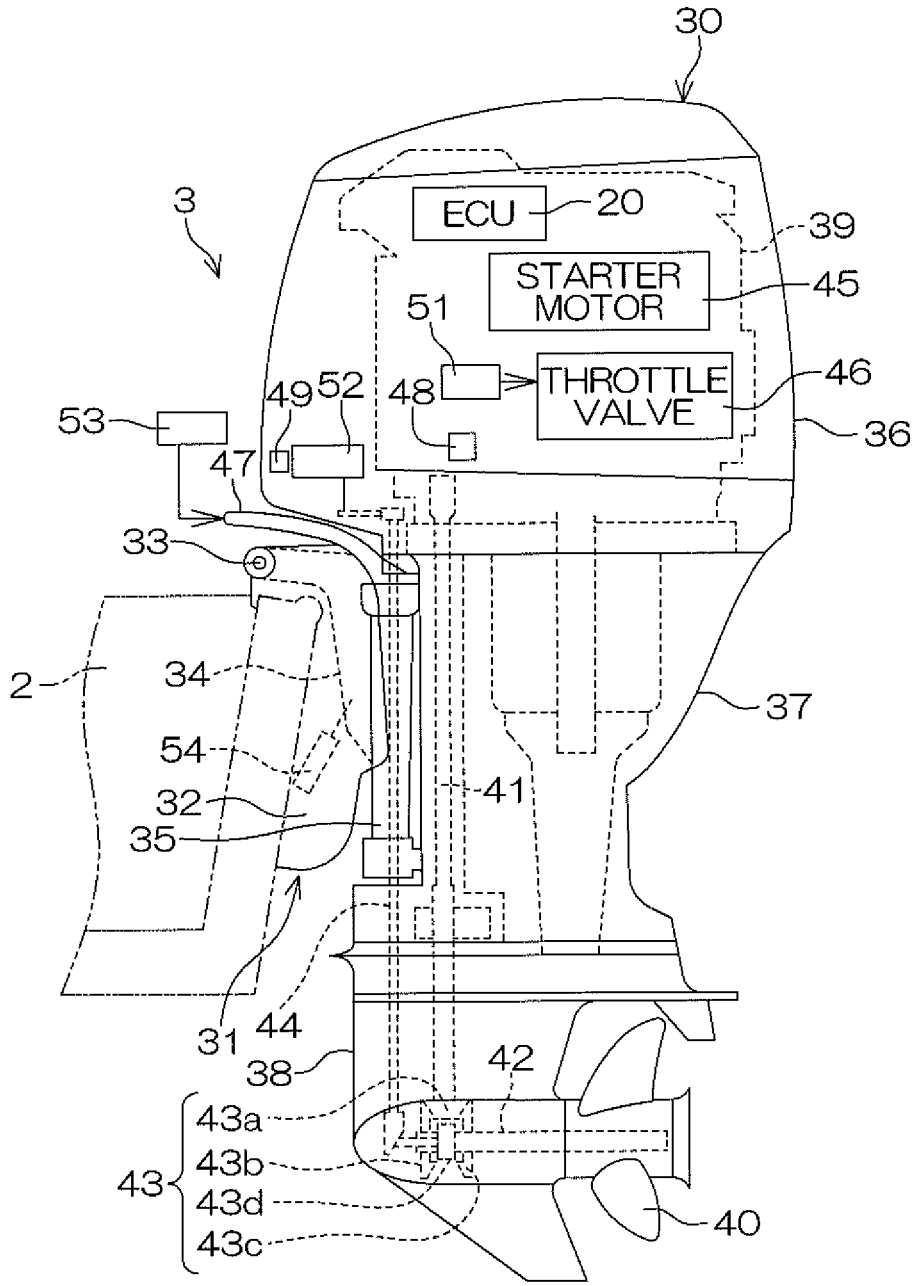
FIG. 3 illustrates an example of the configuration of an outboard motor.

FIG. 3 illustrates an example of the configuration common to the three outboard motors 3. The outboard motors 3 each includes a propulsion unit 30 and a mounting mechanism 31 arranged to mount the propulsion unit 30 on the hull 2. The mounting mechanism 31 includes a clamp bracket 32 detachably fixed to the stern board of the hull 2 and a swivel bracket 34 coupled to the clamp bracket 32 rotatably centering on a tilt axis 33 as a horizontal axis of rotation. The propulsion unit 30 is fitted to the swivel bracket 34 rotatably about a steering axis 35. With this arrangement, the steering angle (angle of direction of the propulsive force with respect to the centerline of the hull 2) can be changed by rotating the propulsion unit 30 about the steering axis 35. The trim angle of the propulsion unit 30 can also be changed by rotating the swivel bracket 34 about the tilt axis 33. The trim angle corresponds to an angle at which the outboard motor 3 is mounted on the hull 2.

The housing of the propulsion unit 30 includes by a top cowling or engine cover 36, an upper case 37, and a lower case 38. Inside the top cowling 36 is installed an engine 39 as a drive source with its crankshaft line extending vertically. A power transmitting drive shaft 41 is connected at the lower end of the crankshaft of the engine 39 and extends vertically through the upper case 37 into the lower case 38.

A propeller 40 as a propulsive force generation member is installed rotatably in the lower portion and on the rear side of the lower case 38. In the lower case 38, a propeller shaft 42 as the rotation axis of the propeller 40 extends horizontally. The rotation of the drive shaft 41 can be transmitted to the propeller shaft 42 via a shift mechanism 43 such as a clutch mechanism.

The shift mechanism 43 includes a drive gear 43*a* preferably defined by a bevel gear fixed at the lower end of the drive shaft 41, a forward drive gear 43*b* preferably defined by a bevel gear arranged rotatably on the propeller shaft 42, a reverse drive gear 43*c* also defined by a bevel gear arranged rotatably on the propeller shaft 42, and a dog clutch 43*d* arranged between the forward and reverse drive gears 43*b* and 43*c*.

The forward drive gear 43*b* is engaged with the drive gear 43*a* on the front side thereof, while the reverse drive gear 43*c* is engaged with the drive gear 43*a* on the rear side thereof. Therefore, the forward and reverse drive gears 43*b* and 43*c* can rotate in mutually opposite directions.

On the other hand, the dog clutch 43*d* is spline-connected to the propeller shaft 42. That is, the dog clutch 43*d* is slidable on the propeller shaft 42 in its axial direction, but not relatively rotatable with respect to the propeller shaft 42, i.e., only rotatable together with the propeller shaft 42.

The dog clutch 43*d* is slidable on the propeller shaft 42 by a force received from a shift rod 44 which extends vertically in parallel with the drive shaft 41. The shift rod 44 is arranged to be rotated about its axis to move the dog clutch 43*d*. This arrangement allows the dog clutch 43*d* to be controlled to be in a shift position selected from among a forward drive position which is coupled to the forward drive gear 43*b*, a reverse drive position which is coupled to the reverse drive gear 43*c*, and a neutral position which is coupled to neither the forward drive gear 43*b* nor the reverse drive gear 43*c*.

When the dog clutch 43*d* is in the forward drive position, the rotation of the forward drive gear 43*b* is transmitted to the propeller shaft 42 via the dog clutch 43*d*. This causes the propeller 40 to rotate in a direction (forward drive direction) to generate a propulsive force in the forward drive direction of the hull 2. On the other hand, when the dog clutch 43*d* is in the reverse drive position, the rotation of the reverse drive gear 43*c* is transmitted to the propeller shaft 42 via the dog clutch 43*d*. Since the reverse drive gear 43*c* can rotate in the opposite direction of the forward drive gear 43*b*, this causes the propeller 40 to rotate in the opposite direction (reverse drive direction) to generate a propulsive force in the reverse drive direction of the hull 2. When the dog clutch 43*d* is in the neutral position, the rotation of the drive shaft 41 is not transmitted to the propeller shaft 42. That is, since the connection through the power transmission path between the engine 39 and the propeller 40 is blocked or disconnected, no propulsive force is generated in any direction.

A starter motor 45 arranged to start the engine 39 is arranged in association with the engine 39. The starter motor 45 is controlled by an outboard motor ECU (Electronic Control Unit) 20. A throttle actuator 51 is provided and is arranged to operate a throttle valve 46 in the engine 39 so as to change the throttle opening degree, whereby the intake air amount of the engine 39 is changed. The throttle actuator 51 may include an electric motor. The operation of the throttle actuator 51 is controlled by the outboard motor ECU 20. The engine 39 further includes an engine speed detecting portion 48 arranged to detect the speed of the engine 39 by detecting the rotation of the crankshaft.

A shift actuator 52 (clutch actuator) arranged to change the shift position of the dog clutch 43*d* is provided in association with the shift rod 44. The shift actuator 52 includes, for example, an electric motor and its operation is controlled by the outboard motor ECU 20. In association with the shift actuator 52, a shift position sensor 49 is provided and is arranged to detect the shift position of the shift mechanism 43.

Further, a steering rod 47 is fixed to the propulsion unit 30, and a steering mechanism 53 arranged to be driven by the steering operation apparatus 6 (see FIG. 1) is coupled to the steering rod 47. The steering mechanism 53 allows the propulsion unit 30 to rotate about the steering axis 35 to thereby provide steering operations.

A trim actuator (tilt trim actuator) 54 is arranged between the clamp bracket 32 and the swivel bracket 34. The trim actuator 54 includes, for example, a hydraulic cylinder and controlled by the outboard motor ECU 20. The trim actuator 54 can rotate the propulsion unit 30 about the tilt axis 33 by rotating the swivel bracket 34 about the tilt axis 33.

Figure 4:
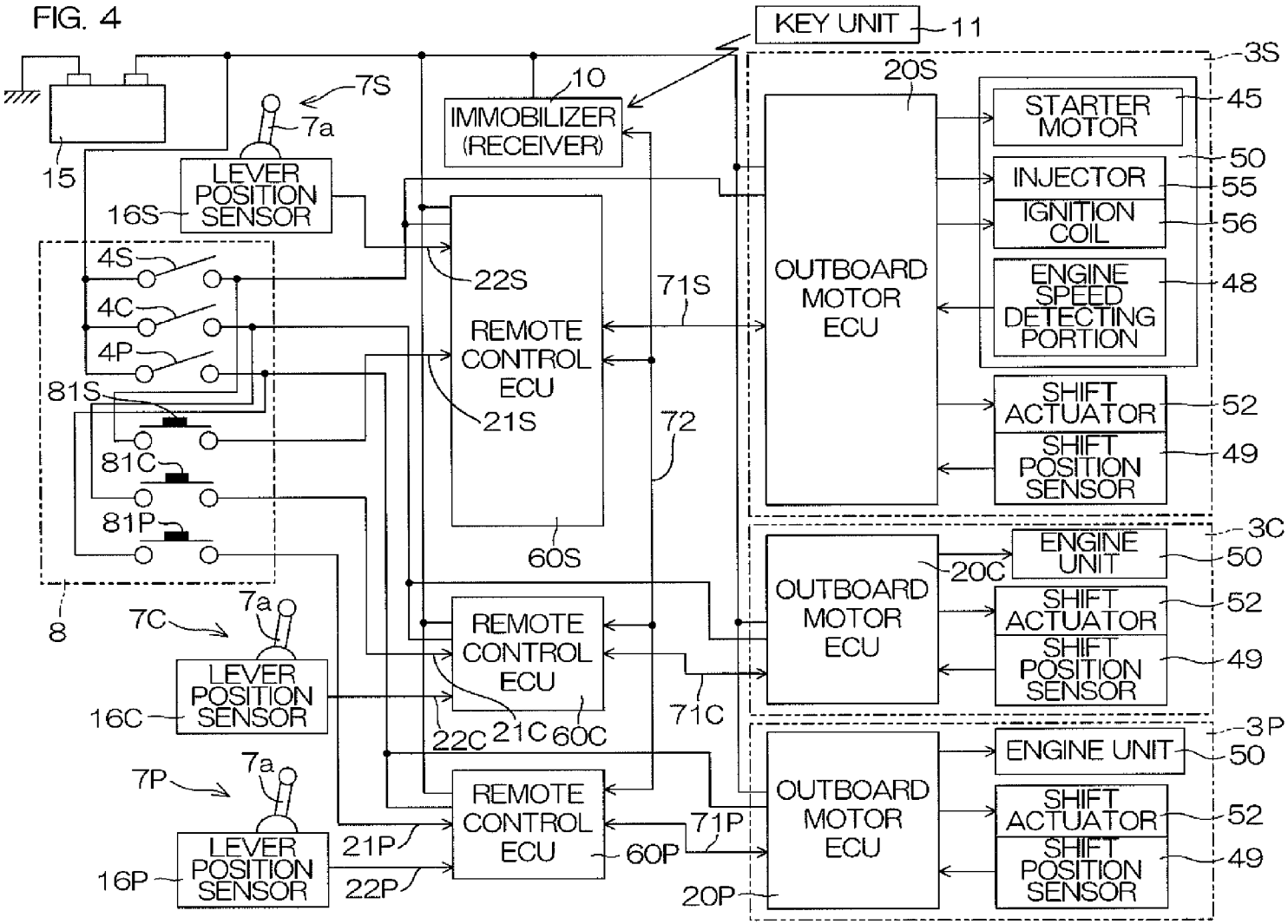
FIG. 4 illustrates the electrical configuration of the marine vessel.

FIG. 4 illustrates the electrical configuration of the marine vessel 1. The gauges 9 and power indicators 83 are not shown in this figure.

Starboard-side remote control ECU (Electronic Control Unit) 60S, center remote control ECU 60C, and portside remote control ECU 60P (hereinafter collectively referred to as "remote control ECUs 60" when appropriate) are provided correspondingly to the starboard-side remote control apparatus 7S, center remote control apparatus 7C, and portside remote control apparatus 7P. These remote control ECUs 60S, 60C, and 60P are arranged to be capable of communicating command signals and other necessary information with the corresponding outboard motor ECUs 20S, 20C, and 20P (each corresponding to the outboard motor ECU 20 in FIG. 3), respectively, via communication lines 71S, 71C, and 71P. The remote control ECUs 60S, 60C, and 60P are also arranged to be capable of communicating information with each other via a communication line 72. These communication lines 71S, 71C, 71P, and 72 may be in a form of a LAN (Local Area Network) built in the marine vessel 1.

The immobilizer 10 (receiver) is connected to the remote control ECUs 60S, 60C, and 60P via the communication line 72. The immobilizer 10 can perform user authentication processing through radio communications with the key unit 11, as described above. If an unlock signal is received from the key unit 11 and the user authentication processing is completed successfully, the immobilizer 10 inputs an unlock command to the remote control ECUs 60S, 60C, and 60P.

The remote control ECUs 60, outboard motor ECUs 20, and immobilizer 10 are supplied with power from a battery 15 as a power source. Three batteries 15 may be provided correspondingly to the three respective outboard motors 3; however, in this preferred embodiment, one battery 15 preferably is shared by the three outboard motors 3 for power supply, for example.

On the other hand, the key switch 4S provided on the control panel 8 has two terminals, one being connected to the battery 15 and the other being connected to the starboard-side remote control ECU 60S and starboard side outboard motor ECU 20S. The key switch 4C also has two terminals, one being connected to the battery 15 and the other being connected to the center remote control ECU 60C and center outboard motor ECU 20C. The key switch 4P also has two terminals, one being connected to the battery 15 and the other being connected to the portside remote control ECU 60P and portside outboard motor ECU 20P.

When a key switch 4 is operated and turned ON to provide a conduction path, power circuits incorporated in the corresponding remote control ECU 60 and outboard motor ECU 20 are activated, and thus computers incorporated in the ECUs 60 and 20 start to operate. When the key switch 4 is operated and turned OFF to break the conduction path, the corresponding remote control ECU 60 and outboard motor ECU 20 perform predetermined termination processing, and thereafter the power supply for the power circuits is shut off to stop their operations.

First ends of the respective start/stop switches 81S, 81C, and 81P are connected, respectively, to input ports 21S, 21C, and 21P (hereinafter collectively referred to as "input ports 21" as appropriate) of the starboard side outboard motor ECU 20S, center outboard motor ECU 20C, and portside outboard motor ECU 20P. Second ends of the respective start/stop switches 81S, 81C, and 81P are connected to the battery 15 via the corresponding key switches 4S, 4C, and 4P. The start/stop switches 81 are each formed by, for example, a push-button switch and, in particular, a momentary switch that provides a conduction path only while being pressed down. Therefore, each start/stop switch 81, if operated while the corresponding key switch 4 provides a conduction path, can generate a significant signal only during its operation. If this signal is generated while the engine 39 in the corresponding outboard motor 3 is stopped, the corresponding remote control ECU 60 interprets the signal as a start command. On the other hand, if a signal from each start/stop switch 81 is input while the engine 39 in the corresponding outboard motor 3 operates, the corresponding remote control ECU 60 interprets the signal as a stop command.

The starboard-side remote control apparatus 7S, center remote control apparatus 7C, and portside remote control apparatus 7P include, respectively, lever position sensors 16S, 16C, and 16P (hereinafter collectively referred to as "lever position sensors 16" as appropriate). The lever position sensors 16S, 16C, and 16P are arranged to detect the operational position of the corresponding remote control lever 7*a* and each formed by, for example, a potentiometer. Output signals from these lever position sensors 16S, 16C, and 16P are input, respectively, to input ports 22S, 22C, and 22P (hereinafter collectively referred to as "input ports 22" as appropriate) of the corresponding remote control ECUs 60S, 60C, and 60P. Each remote control ECU 60 sets the target shift position of the corresponding shift mechanism 43 and the target engine speed of the corresponding engine 39 based on lever position information input to its input port 22, and sends the set values to the corresponding outboard motor ECU 20 via the communication line 71.

The outboard motor ECUs 20 are arranged to control the operation of the corresponding starter motors 45, shift actuators 52, and other components. The outboard motor ECUs 20 are also arranged to input an engine speed detected by the corresponding engine speed detecting portions 48, a shift position detected by the corresponding shift position sensors 49, and other information. The outboard motor ECUs 20 are further arranged to control an injector 55 and an ignition coil 56. The injector 55 is an apparatus arranged to inject fuel into an intake pipe of the engine 39. The control of the injector 55 by the outboard motor ECU 20 is called fuel injection control. The ignition coil 56 is an apparatus arranged to apply a high voltage to a spark plug arranged to ignite the mixture of fuel and air via electric discharge in the combustion chamber of the engine 39. The control of the ignition coil 56 by the outboard motor ECU 20 is called ignition control. The starter motors 45 are each arranged to be energized, when starting the corresponding engine 39, to start a cranking operation for rotating the crankshaft of the engine 39, as described above. The control of the starter motor 45 by the outboard motor ECU 20 is called start control. The starter motor 45, injector 55, ignition coil 56, and engine speed detecting portion 48 constitute an engine unit 50 together with the engine 39.

Figure 5:
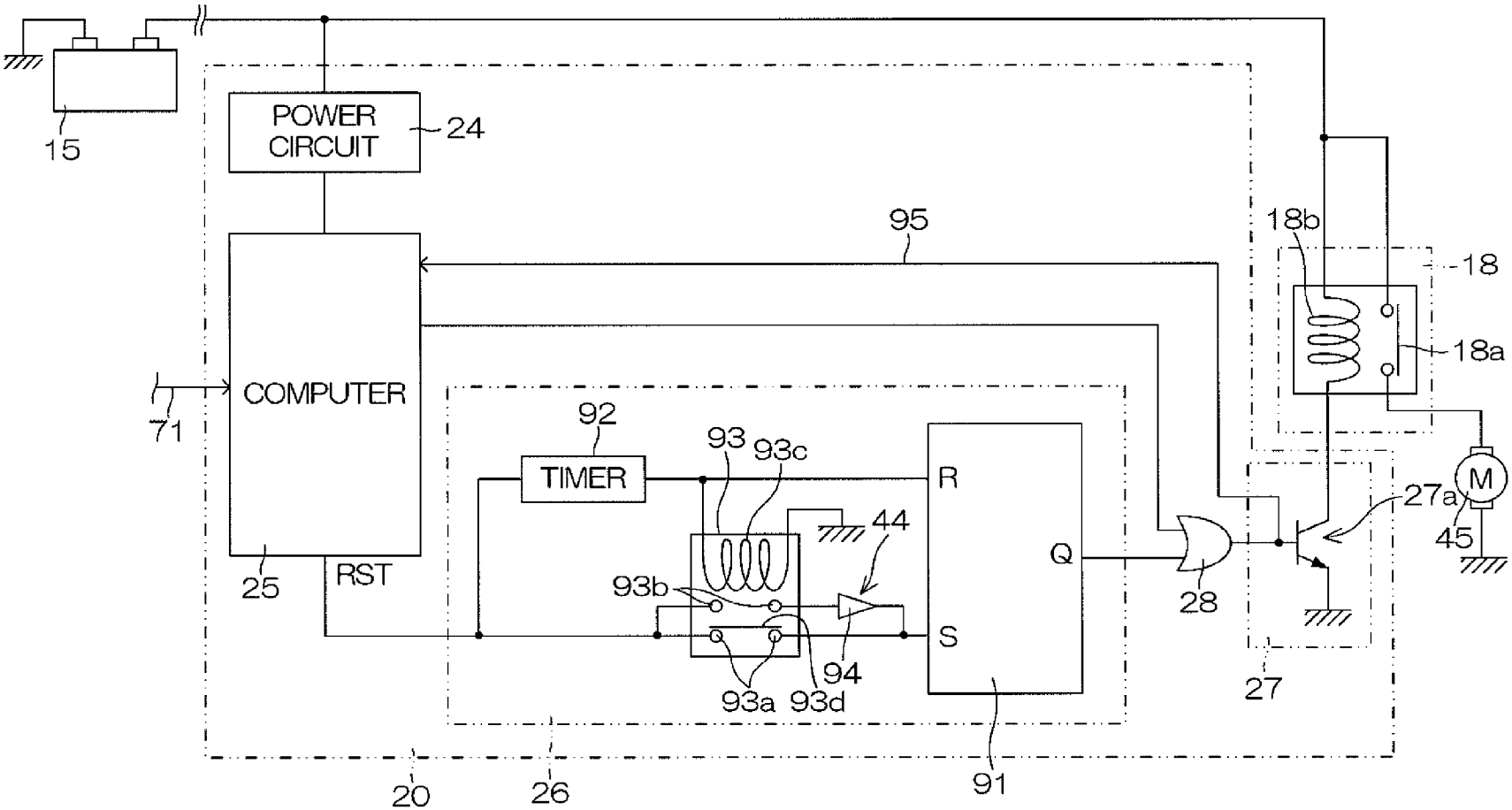
FIG. 5 is an electric diagram showing a specific electrical configuration example associated with a starter motor.

FIG. 5 is an electric diagram showing a specific electrical configuration example associated with the starter motor 45. The starter motor 45 is supplied with power from the battery 15 via a starter relay 18. The starter relay 18 includes a contact piece 18*a* and an operation coil 18*b*. The contact piece 18*a* is arranged to open and close the electricity path between the battery 15 and the starter motor 45. The operation coil 18*b* is connected between the battery 15 and the outboard motor ECU 20 and its excitation/demagnetization is controlled by the outboard motor ECU 20. Exciting the operation coil 18*b* causes the contact piece 18*a* to be closed. Demagnetizing the operation coil 18*b* causes the contact piece 18*a* to be opened.

The outboard motor ECU 20 includes a power circuit 24, a computer 25, an engine start holding circuit 26, a starter relay drive circuit 27, and an OR gate 28.

The power circuit 24 is supplied with power from the battery 15 to supply an operating voltage (e.g., about 5V) to the computer 25. The starter relay drive circuit 27 includes a switching transistor 27*a*. The outboard motor ECU 20 is arranged to excite the operation coil 18*b* by turning the switching transistor 27*a* on (start control). This causes the starter relay 18 to provide a conduction path, whereby the starter motor 45 to be driven.

The engine start holding circuit 26 is arranged to hold the switching transistor 27*a* in an on-state for a certain period of time when the computer 25 gets in a reset state while the start control is performed. This allows the starter relay 18 to keep providing the conduction path even if the computer 25 may be reset and thereby the start control may be suspended. The continued operation of the starter motor 45 can thus be ensured.

That is, when the starter motor 45 is driven and a large current is supplied, a significant voltage drop occurs through the feeder cable, and the operating voltage of the computer 25 may not be ensured sufficiently. If the operating voltage thus drops, the computer 25 will get in a reset state to avoid an abnormality in the control. Such a reset action during the start control may cause the control to be suspended and the engine 39 cannot be started. Hence, the engine start holding circuit 26 is arranged to ensure the continued operation of the starter motor 45 so that the engine 39 can be started reliably.

The engine start holding circuit 26 includes an RS (set-reset) flip-flop 91, a timer 92, a relay 93, and an inverter 94. The relay 93 includes a normally-closed contact 93*a*, a normally-opened contact 93*b*, an operation coil 93*c*, and a contact piece 93*d*. The set terminal (S) of the flip-flop 91 is connected to the reset terminal (RST) of the computer 25 via the normally-closed contact 93*a* and, in parallel to this, also via the normally-opened contact 93*b* and inverter 94 in the relay 93.

The reset terminal (RST) of the computer 25 is held at a low-level potential when the computer 25 performs a normal control operation, while at a high-level potential when the computer 25 is in a reset state.

The input terminal of the timer 92 is also connected with the reset terminal (RST) of the computer 25. The output terminal of the timer 92 is connected with the reset terminal (R) of the flip-flop 91. The timer 92 is arranged to, when the potential of the reset terminal (RST) of the computer 25 rises from the low to high level, synchronously start a timing operation and, after the timing operation for a predetermined period of time, output a high-level signal. When the timer 92 outputs such a high-level signal, the operation coil 93*c* in the relay 93 is to be excited.

The output terminal (Q) of the flip-flop 91 is connected to the control terminal (base) of the switching transistor 27*a* through the OR gate 28. Therefore, when the flip-flop 91 outputs a high-level signal, the switching transistor 27*a* is to be turned on.

When the computer 25 performs a normal control operation, the reset terminal (RST) of the computer 25 is at the low-level potential. In this case, the flip-flop 91 receives a low-level signal through its set terminal (S) and therefore outputs a low-level signal through its output terminal (Q). In this state, if an engine start signal (high-level one) is input from the computer 25 to the OR gate 28, the switching transistor 27*a* is to be turned on and the starter motor 45 is to be driven to start a cranking operation.

When the voltage supplied to the outboard motor ECU 20 drops during cranking and the computer 25 gets in a reset state with reduced voltage generated by the power circuit 24, the output signal from the reset terminal (RST) turns from the low to high level. This causes a high-level signal to be output from the output terminal (Q) of the flip-flop 91 and thereby the switching transistor 27*a* to be held in the on-state. That is, the starter motor 45 will continue to be driven to continue the cranking operation.

On the other hand, the signal input to the timer 92 will rise to a high level, which causes the timer to start a timing operation. After the timing operation for a certain period of time, when the timer 92 outputs a high-level signal, the flip-flop 91 is to be reset and further the operation coil 93*c* in the relay 93 is to be excited to cause the contact piece 93*d* to switch to the normally-opened contact 93*b*. As a result, the high-level signal from the reset terminal of the computer 25 will be turned to a low-level signal through the inverter 94 and input to the set input terminal (S) of the flip-flop 91. This causes the flip-flop 91 to output a low-level signal, whereby the switching transistor 27*a* will be turned off and the starter motor 45 will be stopped.

Thus, even if the computer 25 may be reset during cranking, the cranking operation cannot be stopped for a certain period of time thereafter, and therefore the engine 39 can be started reliably.

Figure 6:
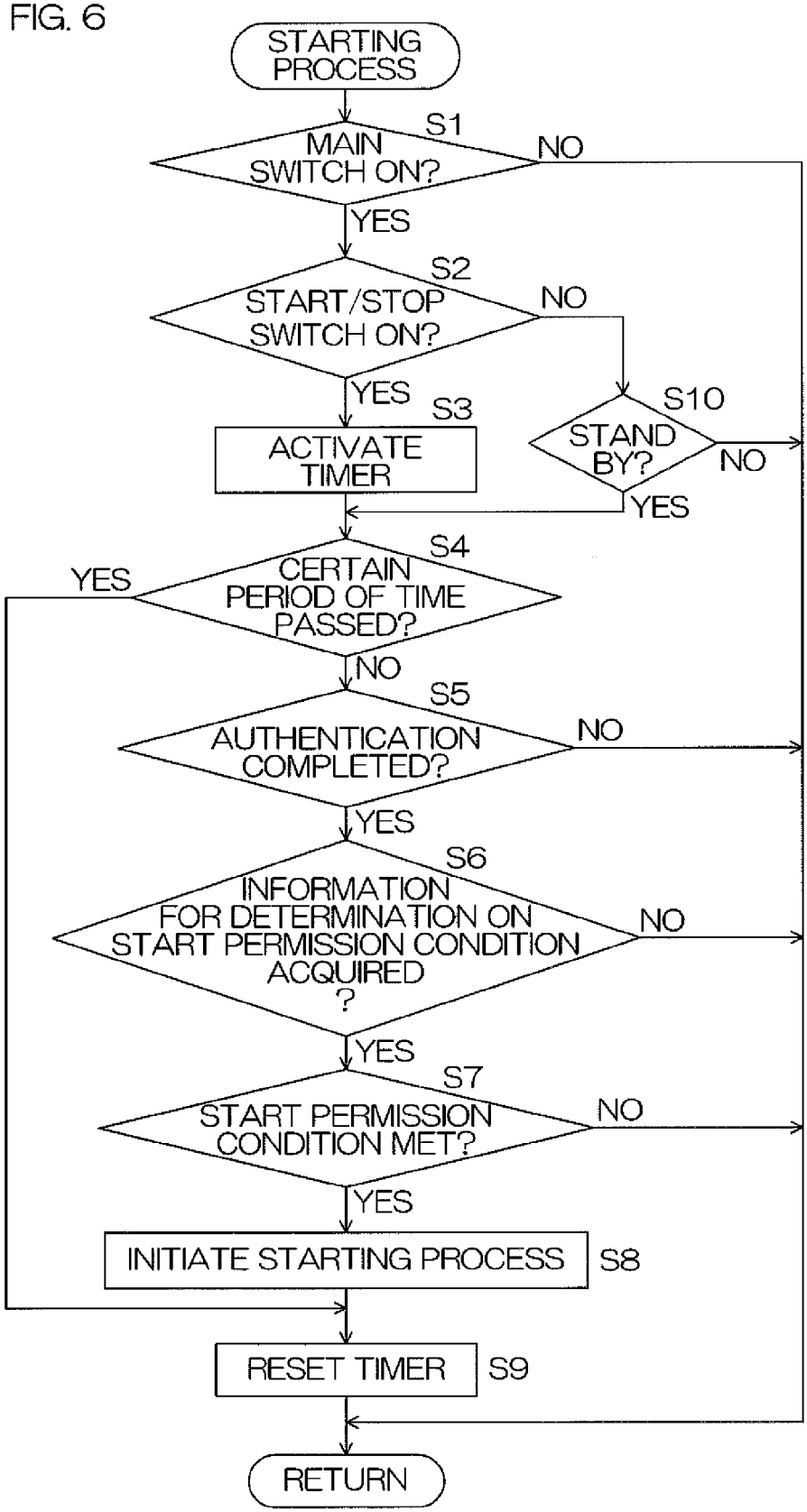
FIG. 6 is a flow chart illustrating engine start control by a remote control ECU.

FIG. 6 is a flow chart illustrating repetitive processing performed by the computer incorporated in each remote control ECU 60 every predetermined control cycle and, in particular, illustrating control for the start of the engine 39 in the corresponding outboard motor 3. When the key switch 4 (main switch) provides a conduction path (Step S1), the remote control ECU 60 determines if there is an input from the corresponding start/stop switch 81 (Step S2). If it is determined that the start/stop switch 81 is operated (YES in Step S2), the remote control ECU 60 activates a built-in timer (Step S3) to measure time passing after the operation of the start/stop switch 81. The remote control ECU 60 then determines if a certain period of time (e.g., about 0.3 seconds) has passed (Step S4). If the certain period of time has not yet passed, the remote control ECU 60 determines if an authentication process is completed (Step S5).

The authentication process includes a user authentication process, an immobilizer authentication process, and a remote control authentication process. In the user authentication process, a user authentication code generated by the key unit 11 is checked and authenticated in the immobilizer 10. In the immobilizer authentication process, an immobilizer authentication code generated by the immobilizer 10 is checked and authenticated against an authentication code preliminarily registered in each remote control ECU 60. In the remote control authentication process, a remote control authentication code generated by each remote control ECU 60 is checked and authenticated against an authentication code preliminarily registered in the corresponding outboard motor ECU 20. The authentication process cannot be completed until all of the user authentication process, immobilizer authentication process, and remote control authentication process are completed. If any of the authentication processes have not yet been completed or unsuccessfully completed, it is determined that the authentication process is not completed. The immobilizer authentication process is performed in each remote control ECU 60.

The authentication process, which is started when an unlocking operation by the key unit 11 is performed, is generally completed before the start/stop switch 81 is operated. However, if there is only an extremely small time difference between the operation of the key unit 11 and the operations of the key switch 4 and start/stop switch 81, the authentication process may not be completed at the time the user operates the start/stop switch 81.

If the authentication process has been completed (YES in Step S5), the remote control ECU 60 determines if full information necessary for determination of a start permission condition (individual start permission condition) has been acquired (Step S6). The start permission condition includes that the operational position of the corresponding remote control lever 7*a* (target shift position) is in the neutral position, that the shift position of the shift mechanism 43 (actual shift position) is also in the neutral position, and that the engine 39 is stopped. The operational position of the remote control lever 7*a* can be acquired immediately from the corresponding lever position sensor 16. On the other hand, the information about the actual shift position of the shift mechanism 43 can be acquired through inter-ECU communications with the outboard motor ECU 20. The information about the engine speed can also be acquired through inter-ECU communications with the outboard motor ECU 20. Accordingly, a certain amount of time is required to acquire the information. The information may not have been acquired immediately after the key switch 4 is operated for power-on.

If the information necessary for determination of the start permission condition has been fully acquired (YES in Step S6), the remote control ECU 60 determines if the start permission condition is met (Step S7). If the start permission condition is met (YES in Step S7), the remote control ECU 60 initiates a starting process (Step S8) and resets the timer to terminate its timing operation (Step S9).

In the starting process, an engine start command is provided to the outboard motor ECU 20 via the communication line 71. The outboard motor ECU 20 receiving the engine start command activates the starter relay drive circuit 27 to drive the starter motor 45 (start control) and thereby to start a cranking operation. At the same time, the outboard motor ECU 20 performs ignition control and fuel injection control to start the engine 39.

If the authentication process has not yet been completed (NO in Step S5), if the information necessary for determination of the start permission condition has not yet been acquired (NO in Step S6), or if the start permission condition is not met (NO in Step S7), the routine at this control cycle terminates without performing the starting process (Step S8).

If it is determined that the start/stop switch 81 is not operated (NO in Step S2), the remote control ECU 60 determines if the control is in a stand-by state (Step S10). The stand-by state means that the timer is performing a timing operation (Step S3). If in the stand-by state (YES in Step S10), the routine goes to Step S4. If not in the stand-by state (NO in Step S10), the routine terminates at this control cycle.

In Step S4, if it is determined, based on the timing operation by the timer, that the certain period of time has passed, the remote control ECU 60 resets the timer to terminate its timing operation (Step S9). The routine then terminates at this control cycle.

Based on the above-described operations, when the start/stop switch 81 is operated, the starting process is to be suspended until the certain period of time passes to complete the authentication process and to acquire the information necessary for determination of the start permission condition. Therefore, even if the start/stop switch 81 may be operated to provide a start command immediately after the authentication process is started or the key switch 4 is turned ON, the start command cannot be disabled immediately but held in an enabled state for a certain period of time. Then, after the completion of the authentication process and acquisition of the information for determination of the start permission condition, a process necessary for the start of the engine 39 will be performed. This results in a starting process reflecting the user's intentions. Also, since the stand-by time is limited, there can be no possibility that the engine 39 is started after an extremely long period of stand-by time, which is undesirable.

Figure 7:
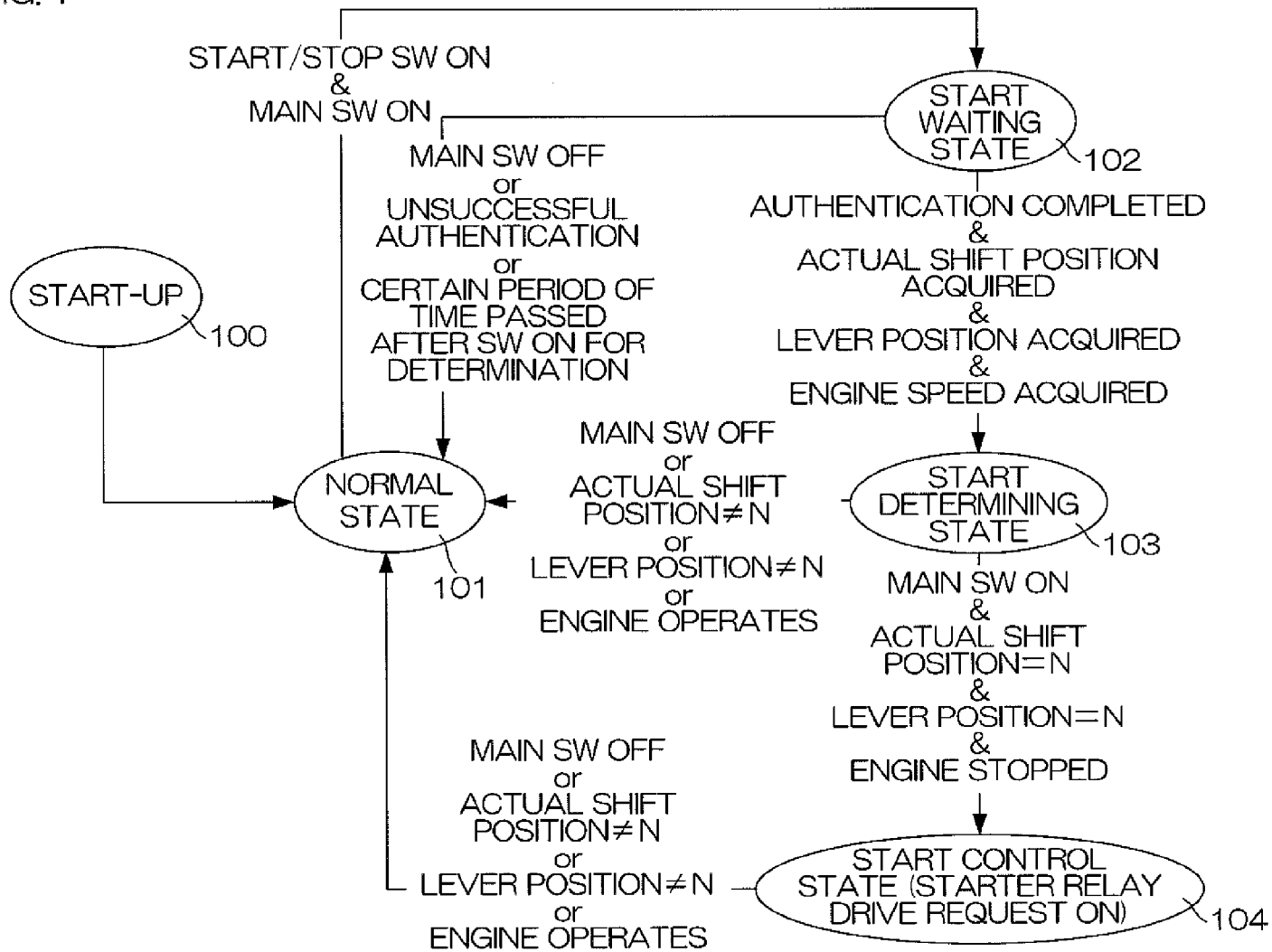
FIG. 7 illustrates the state transition of the remote control ECU.

FIG. 7 illustrates the state transition of the remote control ECU 60. If the built-in computer is activated in a start-up state 100, the control of the remote control ECU 60 transits to a normal state 101. In the normal state 101, if the key switch 4 (main SW) is ON and the start/stop switch 81 (start/stop SW) is turned on, the control transits to a start waiting state 102. In the start waiting state 102, if the authentication has been completed and the information (actual shift position, lever position, and engine speed) necessary for determination of the start condition has been acquired, the control transits to a start determining state 103. In the start waiting state 102, if the key switch 4 (main SW) is turned OFF, if the authentication has been unsuccessfully completed, or if a certain period of time has passed after the operation of the start/stop switch 81, the control transits back to the normal state 101.

In the start determining state 103, if the key switch 4 (main SW) is turned OFF, if the actual shift position is not in the neutral position, if the lever position is not in the neutral position, or if the engine operates, the control transits to the normal state 101. In the start determining state 103, if the key switch 4 (main SW) is ON, the actual shift position is in the neutral position, the lever position is in the neutral position, and the engine is stopped, the control transits to a start control state 104. That is, an engine start command is provided to the outboard motor ECU 20.

In the start control state 104, if the key switch 4 (main SW) is turned OFF, if the actual shift position is displaced from the neutral position, if the lever position is displaced from the neutral position, or if the engine starts to operate, the control transits to the normal state 101. That is, the start control terminates. That is, if connection through the power transmission path between the engine 39 and the propeller 40 is provided and/or the remote control lever 7*a* is operated, the cranking operation is stopped. Also, if the engine 39 starts to operate, this means that the starting process for the engine 39 has been completed and the cranking operation is no longer needed, and the control transits to the normal state 101.

Figure 8:
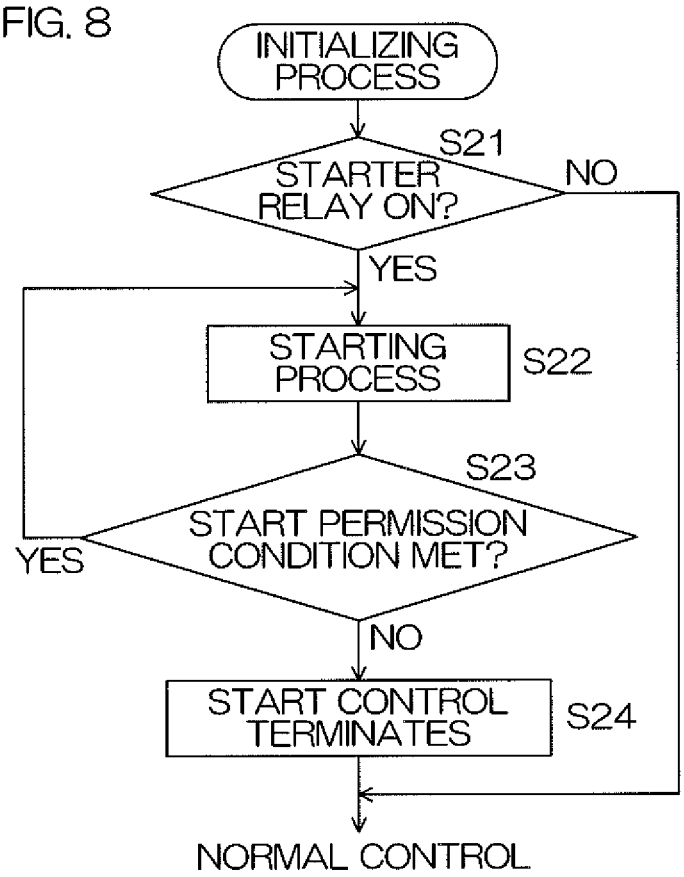
FIG. 8 is a flow chart illustrating the operation (initializing process) of an outboard motor ECU at the start of an engine.

FIG. 8 is a flow chart illustrating the operation of each outboard motor ECU 20 at the start of the corresponding engine and, in particular, illustrating an initializing process. The initializing process is for starting the computer 25 in the outboard motor ECU 20. The initializing process is to be performed not only after power-on but also during restart after reset.

The outboard motor ECU 20 determines if the starter relay 18 is in an on-state (Step S21). More specifically, as shown in FIG. 5, the control signal input to the base of the switching transistor 27*a* is monitored by the computer 25 via the line 95, and if this control signal is at a high level, it is determined that the starter relay 18 is in the on-state.

The starter relay 18 can be in the on-state during the start process if its on-state is held by the operation of the engine start holding circuit 26. That is, this is in the case where the outboard motor ECU 20 is reset during cranking. If it is determined that the starter relay 18 is in the on-state, the outboard motor ECU 20 performs a starting process (Step S22). The starting process in this case includes start control for turning the switching transistor 27*a* in the starter relay drive circuit 27 on as well as ignition control and fuel injection control.

The outboard motor ECU 20 further determines if the start permission condition is met (Step S23). That is, it is determined if the actual shift position is in the neutral position, if the lever position is in the neutral position, and if the engine is stopped (in this case, the engine does not reach a complete-explosion speed). If the start permission condition is met (YES in Step S23), the starting process is performed continuously (Step S22).

If the start permission condition is not met (NO in Step S23), the start control terminates (Step S24). That is, when the engine 39 is started, the starter motor 45 is de-energized.

After that, normal control is to be performed. In the normal control, an engine start command is provided from the remote control ECU 60 to cause the starter relay 18 to provide a conduction path, while an engine stop command is provided from the remote control ECU 60 to stop the ignition control and fuel injection control and thereby to stop the engine 39.

As described heretofore, in this preferred embodiment, even if the computer 25 in the outboard motor ECU 20 may be reset during cranking, the starter motor 45 is kept energized by the operation of the engine start holding circuit 26. This allows the engine 39 to be started reliably. Then, in an initializing process after the reset action, it is determined if there has been a reset action during cranking. If YES in this determination, the starting process will be continued. This allows the engine 39 to be started reliably. Then, after the engine 39 is started (NO in Step S23), the starter motor 45 can be de-energized immediately.

Figure 9:
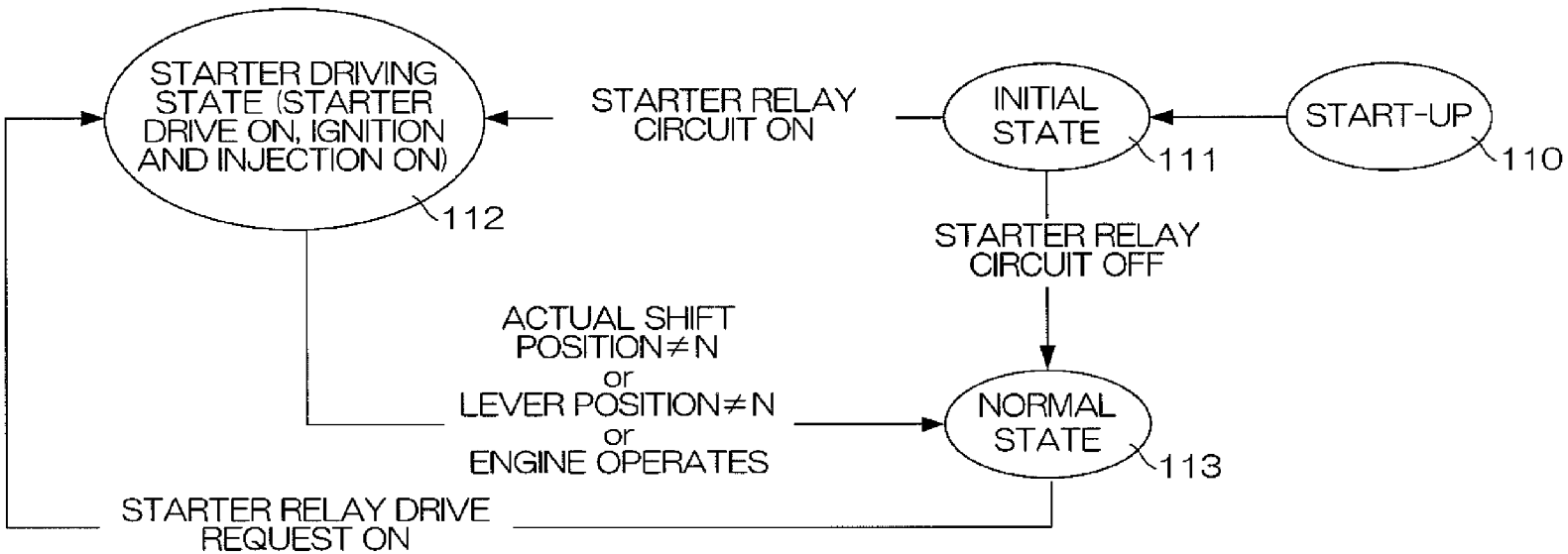
FIG. 9 illustrates the state transition of the outboard motor ECU.

FIG. 9 illustrates the state transition of the outboard motor ECU 20. The control of the outboard motor ECU 20 transits from a start-up state 110 to an initial state 111 through an initializing process. In this case, if the starter relay 18 provides a conduction path, the control transits to a starter driving state 112 where the starter relay 18 keeps providing the conduction path as well as ignition control and fuel injection control are performed. In the initial state 111, if the starter relay 18 does not provide a conduction path, the control transits to a normal state 113. In the normal state 113, if an engine start command is provided from the remote control ECU 60 (starter relay drive request ON), the control transits to the starter driving state 112.

In the starter driving state 112, if the start permission condition is not met, the start control (driving of the starter motor 45) is stopped and the control transits to the normal state 113.

Figure 10:
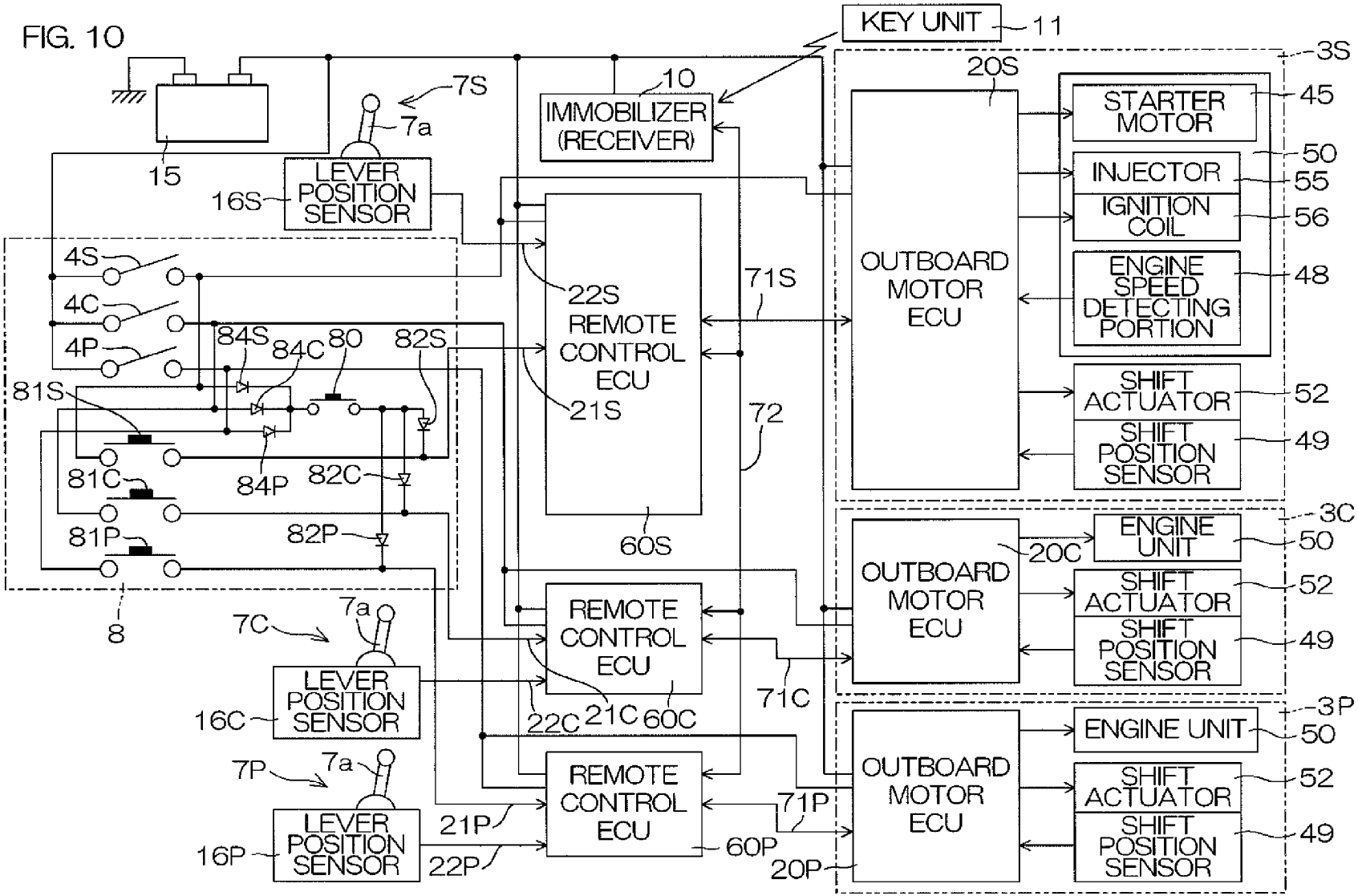
FIG. 10 is a block diagram illustrating the electrical configuration of a marine vessel according to a second preferred embodiment of the present invention.

FIG. 10 is a block diagram illustrating the electrical configuration of a marine vessel according to a second preferred embodiment of the present invention. In FIG. 10, components corresponding to those shown in FIG. 4 are designated by the same reference numerals as in FIG. 4.

In the second preferred embodiment, the control panel 8 includes an all-device start/stop switch 80 for collectively starting all startable outboard motors 3 and collectively stopping all operating outboard motors 3. One end of the all-device start/stop switch 80 is connected commonly to the input ports 21 of all the remote control ECUs 60. The other end of the all-device start/stop switch 80 is connected to the battery 15 via the key switches 4S, 4C, and 4P. More specifically, the one end of the all-device start/stop switch 80 is connected to the input port 21S of the starboard-side remote control ECU 60S via a diode 82S. The one end of the all-device start/stop switch 80 is also connected to the input port 21C of the center remote control ECU 60C via a diode 82C. The one end of the all-device start/stop switch 80 is further connected to the input port 21P of the portside remote control ECU 60P via a diode 82P. The diodes 82S, 82C, and 82P can prevent signals generated when the individual start/stop switches 81S, 81C, and/or 81P are operated from entering the input ports 21 of the remote control ECUs 60 other than the corresponding one of the remote control ECUs 60. The other end of the all-device start/stop switch 80 is connected to the key switch 4S via a diode 84S. The other end of the all-device start/stop switch 80 is also connected to the key switch 4C via a diode 84C. The other end of the all-device start/stop switch 80 is further connected to the key switch 4P via a diode 84P. The diodes 84S, 84C, and 84P can prevent short circuits between the key switches 4.

In the second preferred embodiment, the all-device start/stop switch 80 preferably is a push-button switch and, in particular, a momentary switch that provides a conduction path only while being pressed down, for example. Therefore, the all-device start/stop switch 80, if operated while any of the key switches 4 provides a conduction path, can generate a significant signal only during its operation.

The remote control ECUs 60 are each arranged to make a distinction between the operation of the all-device start/stop switch 80 and the operation of the individual start/stop switches 81 through inter-ECU communications via the communication line 72. That is, the remote control ECUs 60 are each arranged to, when receiving a switch input at the input port 21, determine if the other remote control ECUs 60 also receive a switch input simultaneously at their input ports 21 through inter-ECU communications with the other remote control ECUs 60. If the other remote control ECUs 60 also receive a switch input simultaneously at their input ports 21, it can be determined that the inputs are caused by the all-device start/stop switch 80. Otherwise it can be determined that the inputs are caused by the individual start/stop switches 81.

Figure 11:
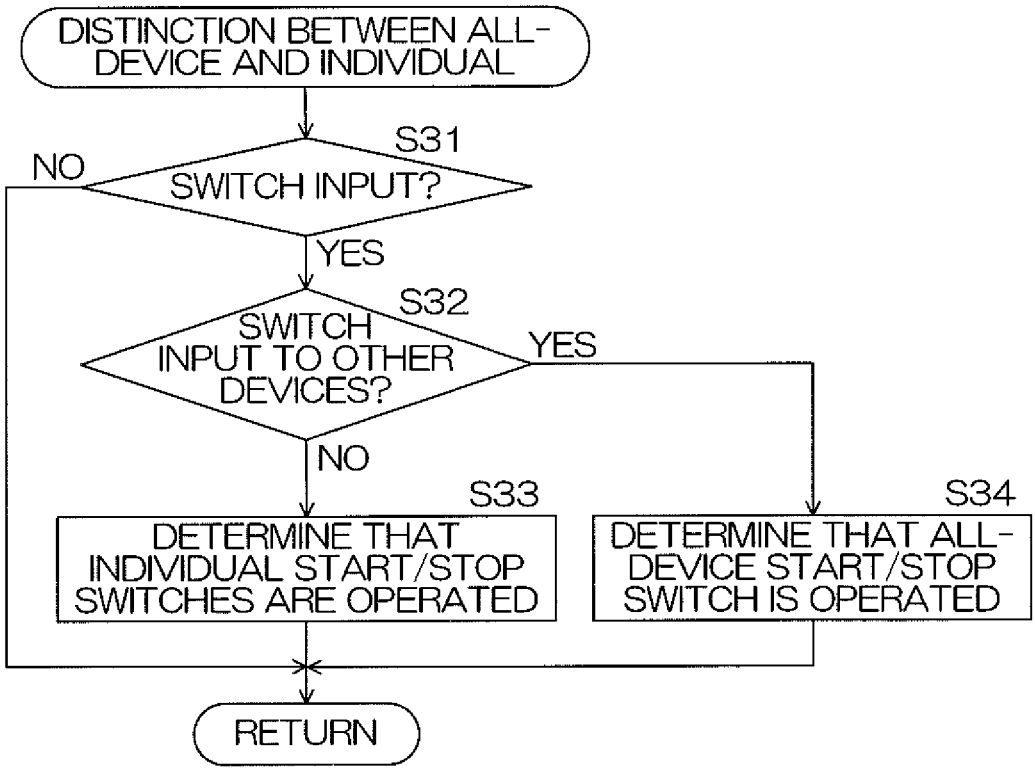
FIG. 11 is a flow chart illustrating a process for distinction between the operation of an all-device start/stop switch and the operation of an individual start/stop switch.

FIG. 11 is a flow chart illustrating repetitive processing performed by the computer incorporated in each remote control ECU 60 every predetermined control cycle. In particular, FIG. 11 illustrates a process for determining if an input signal received at each input port 21 is caused by the operation of the all-device start/stop switch 80 or the operation of the corresponding individual start/stop switch 81.

The remote control ECU 60 monitors the input port 21 to determine if there is a switch input (Step S31). If there is no switch input, the routine for the control cycle terminates.

If there is a switch input (YES in Step S31), the remote control ECU 60 determines if there is a signal input to the input ports 21 of the remote control ECUs 60 corresponding to the other devices (i.e., the other remote control ECUs 60) (Step S32). This determination can be made by acquiring information about the existence of a signal input to the input ports 21 of the other remote control ECUs 60 through communications between the remote control ECUs 60 via the communication line 72.

If there is no signal input to the input ports 21 of the other remote control ECUs 60 (NO in Step S32), that is, there is no signal input simultaneously to the respective input ports 21 of multiple remote control ECUs 60, the remote control ECU 60 determines that the individual start/stop switches 81 are operated (Step S33). If it is determined that the individual start/stop switches 81 are operated with the engine 39 in the corresponding outboard motor 3 being stopped, the starting process (individual starting process) shown in FIG. 6 is to be performed.

On the other hand, if there is a signal input to the input ports 21 of the other remote control ECUs 60 (YES in Step S32), that is, there are signals input simultaneously to the respective input ports 21 of multiple remote control ECUs 60, the remote control ECU 60 determines that the all-device start/stop switch 80 is operated (Step S34). If it is determined that the all-device start/stop switch 80 is operated with the engine 39 in the corresponding outboard motor 3 being stopped, the following all-device starting process is to be performed (see FIG. 12).

Figure 12:
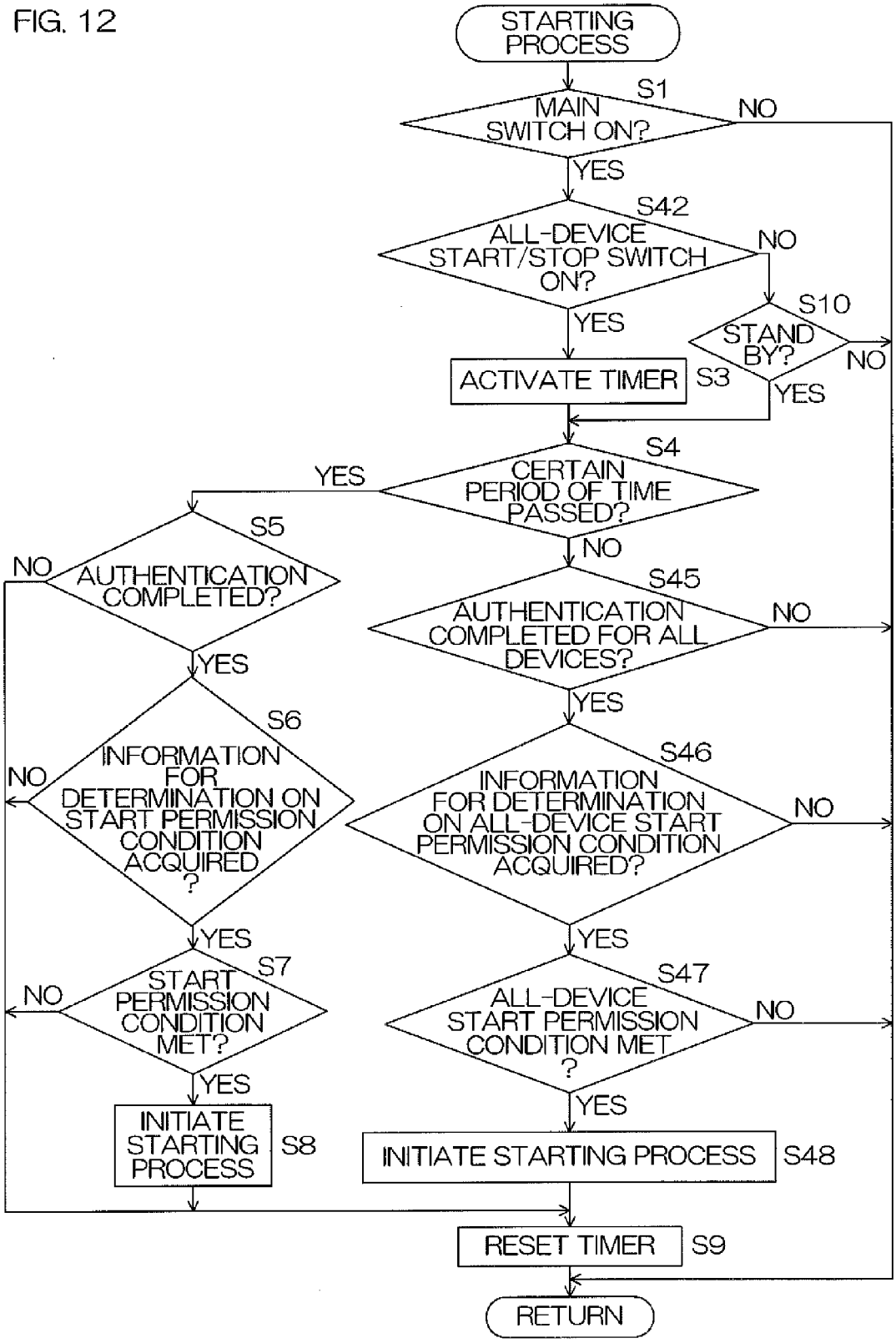
FIG. 12 is a flow chart illustrating a starting process performed by a remote control ECU in response to the operation of the all-device start/stop switch.

FIG. 12 is a flow chart illustrating repetitive processing performed by each remote control ECU 60 every predetermined control cycle and, in particular, illustrating a starting process performed in response to the operation of the all-device start/stop switch 80. In FIG. 12, steps corresponding to those shown in FIG. 6 are designated by the same reference numerals as in FIG. 6.

The remote control ECU 60 determines if the corresponding key switch 4 (main switch) provides a conduction path (Step S1) and then determines if there is an input from the all-device start/stop switch 80 (Step S42). This determination can be made based on a result of the process shown in FIG. 11. If it is determined that the all-device start/stop switch 80 is operated (YES in Step S42), the remote control ECU 60 activates a built-in timer (Step S3) to measure time passing after the operation of the all-device start/stop switch 80. The remote control ECU 60 then determines if a certain period of time (e.g., about 0.3 seconds) has passed (Step S4).

If the certain period of time has not passed, the remote control ECU 60 determines if the authentication process has been completed for all of the outboard motors 3 (Step S45). As described above, since the authentication process requires a certain amount of time, the authentication process may not be completed for any of the outboard motors 3 at the time the all-device start/stop switch 80 is operated.

If the authentication process has been completed (YES in Step S45), the remote control ECU 60 determines if full information necessary for determination of a predetermined all-device start permission condition has been acquired (Step S46). The all-device start permission condition includes that the operational positions of the corresponding and the other remote control levers 7*a* (target shift positions) are in the neutral position, that the shift positions of the corresponding and the other shift mechanisms 43 (actual shift positions) are also in the neutral position, and that the corresponding and the other engines 39 (in all of the outboard motors 3) are stopped.

The remote control ECU 60 can acquire the information through inter-ECU communications via the communication lines 71 and 72. Accordingly, a certain amount of time is required to acquire the information. The information may not have been acquired immediately after the corresponding key switch 4 is operated for power-on.

If the information necessary for determination of the all-device start permission condition has been fully acquired (YES in Step S46), the remote control ECU 60 determines if the all-device start permission condition is met (Step S47). If the all-device start permission condition is met (YES in Step S47), the remote control ECU 60 initiates a starting process (Step S48) and resets the timer to terminate its timing operation (Step S9).

If the authentication process has not yet been completed (NO in Step S45), if the information necessary for determination of the all-device start permission condition has not yet been acquired (NO in Step S46), or if the all-device start permission condition is not met (NO in Step S47), the routine for the control cycle terminates without performing the starting process (Step S48).

If it is determined that the all-device start/stop switch 80 is not operated (NO in Step S42), the remote control ECU 60 determines if the control is in a stand-by state (Step S10). The stand-by state means that the timer is performing a timing operation (Step S3). If in the stand-by state (YES in Step S10), the routine goes to Step S4. If not in the stand-by state (NO in Step S10), the routine for the control cycle terminates.

In Step S4, if it is determined, based on the timing operation by the timer, that the certain period of time has passed, the remote control ECU 60 determines if an authentication process for the corresponding outboard motor 3 is completed (Step S5). If the authentication process has been completed (YES in Step S5), the remote control ECU 60 determines if full information necessary for determination of a start permission condition (individual start permission condition) has been acquired for the outboard motor 3 (Step S6). The start permission condition in this case includes that the operational position of the corresponding remote control lever 7*a* (target shift position) is in the neutral position, that the shift position of the shift mechanism 43 (actual shift position) is also in the neutral position, and that the engine 39 is stopped.

If the information necessary for determination of the start permission condition has been fully acquired for the outboard motor 3 (YES in Step S6), the remote control ECU 60 determines if the start permission condition is met (Step S7). If the start permission condition is met (YES in Step S7), the remote control ECU 60 initiates a starting process (Step S8) and resets the timer to terminate its timing operation (Step S9).

If the authentication process has not yet been completed (NO in Step S5), if the information necessary for determination of the start permission condition has not yet been acquired (NO in Step S6), or if the start permission condition is not met (NO in Step S7), the timer is reset (step S9) and the routine at this control cycle terminates without performing the starting process (Step S8).

Based on the above-described operations to be performed in each remote control ECU 60, when the all-device start/stop switch 80 is operated, the starting process is to be suspended until the certain period of time passes to complete the authentication process for all of the outboard motors 3, acquire the information necessary for determination of the all-device start permission condition, and to meet the all-device start permission condition. Therefore, even if the all-device start/stop switch 80 may be operated to provide an all-device start command immediately after the authentication process is started or the key switch 4 is turned ON, the all-device start command cannot be disabled immediately but held in an enabled state for a certain period of time. Then, after the completion of the authentication process for all of the outboard motors 3 and the all-device start permission condition is met, a process necessary for the start of the engines 39 in all of the outboard motors 3 will be performed. This allows the engines 39 in all of the outboard motors 3 to be started collectively.

On the other hand, if the authentication process has not yet been completed for all of the outboard motors 3, if the information necessary for determination of the all-device start permission condition has not yet been acquired, or if the all-device start permission condition is not met until the certain period of time passes, a process for individually starting the engine in each outboard motor 3 is to be performed. That is, each remote control ECU 60 performs a process for individually starting the engine 39 in the corresponding outboard motor 3 (Steps S5 to S8). After stand-by for the certain period of time, both the authentication process and acquisition of the information for determination of the start permission condition should have been completed for startable outboard motors 3. Therefore, the engines 39 in the startable outboard motors 3 can be started individually. For example, the engines 39 in successfully authenticated outboard motors 3 can be started, while the engines 39 in unauthenticated outboard motors 3 cannot be started.

Thus, a starting process reflecting the user's intentions can be performed in response to the operation of the all-device start/stop switch 80. Also, since the stand-by time is limited, there can be no possibility that the engine 39 is started after an extremely long period of stand-by time to bring discomfort to the user.

Although, the engines 39 in the multiple outboard motors 3, when starting collectively, may be started all at once (simultaneously), starting the engines sequentially at intervals is preferable to distribute the load on the battery 15 temporally. That is, it is preferable to predefine starting priorities for the multiple outboard motors 3 and to start the engines 39 in the outboard motors 3 sequentially based on these priorities.

Although the two preferred embodiments of the present invention have heretofore been described, the present invention may be embodied in many other forms. For example, although the preferred embodiments above describe the case where multiple remote control ECUs 60 preferably are provided correspondingly to the respective multiple remote control apparatuses 7, only one remote control ECU may be provided to commonly receive signals from the multiple remote control apparatuses 7. In this case, inter-ECU communications are established between the one remote control ECU and the multiple outboard motor ECUs 20.

Although the preferred embodiments above preferably exemplify a marine vessel propulsion system including an immobilizer 10, the present invention is also applicable to systems including no immobilizer.

Although the preferred embodiments above describe the case where common momentary switches 80 and 81 are preferably used to command the start and stop of each engine, multiple switches may be provided to individually command the start and stop of each engine. Alternatively, a switch capable of outputting a mutually different start command signal and stop command signal (having their respective different voltage levels, for example) may be used as a start/stop switch.

Furthermore, although the first and second preferred embodiments above preferably exemplify a marine vessel including multiple outboard motors, the first preferred embodiment is also applicable to marine vessels including only one outboard motor. It will be appreciated that the first and second preferred embodiments are also applicable to marine vessels including two or four or more outboard motors.

Although the preferred embodiments above preferably exemplify an outboard motor as a propulsion device, the present invention is also applicable to marine vessel propulsion systems including a propulsion device of another type. Examples of such a propulsion device include inboard and outboard motors (stern drive, i.e., inboard motor/outboard drive), inboard motors, and water jet drives.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The present application corresponds to Japanese Patent Application No. 2009-92126 filed in the Japan Patent Office on Apr. 6, 2009, and the entire disclosure of the application is incorporated herein by reference.

What is claimed is:

1. A marine vessel comprising:

a hull;

a propulsion device mounted on a stern of the hull and including an engine and a propulsion device control unit;

a starter switch arranged to be operated by an operator to start the engine; and a main control unit mounted on the hull at an operator's compartment and arranged and programmed to receive a start command from the starter switch and to communicate with the propulsion device control unit, the main control unit including:

a stand-by unit arranged to, when receiving the start command from the starter switch, stand by until information for determination of a predetermined start permission condition is acquired from the propulsion device control unit;

a determining unit arranged to, after the information for determination of the predetermined start permission condition is acquired, determine if the predetermined start permission condition is met; and an engine start command unit arranged to, if the predetermined start permission condition is met, provide an engine start command to the propulsion device control unit; wherein the information for determination of the predetermined start permission condition includes information to be communicated from the propulsion device control unit; and the propulsion device control unit starts the engine upon receipt of the engine start command from the main control unit.

2. The marine vessel according to claim 1, further comprising an authentication unit arranged to authenticate an authorized user, wherein the stand-by unit is arranged to stand by until the authentication unit succeeds in authentication and information for determination of the start permission condition is acquired from the propulsion device control unit.

3. The marine vessel according to claim 1, wherein the stand-by unit is arranged to stand by until a predetermined amount of time passes after the starter switch is operated.

4. A marine vessel control apparatus arranged and programmed to control a propulsion device including an engine and a propulsion device control unit, the marine vessel control apparatus comprising:

a starter switch arranged to be operated by an operator to start the engine; and a main control unit arranged and programmed to receive a start command from the starter switch and to communicate with the propulsion device control unit, the main control unit including:

a stand-by unit arranged to, when receiving the start command from the starter switch, stand by until information for determination of a predetermined start permission condition is acquired from the propulsion device control unit;

a determining unit arranged to, after the information for determination of the predetermined start permission condition is acquired, determine if the predetermined start permission condition is met; and an engine start command unit arranged to, if the predetermined start permission condition is met, provide an engine start command to the propulsion device control unit; wherein the marine vessel control apparatus is arranged and programmed to control a plurality of the propulsion devices and further comprises an authentication unit arranged to perform an authentication process for authentication of an authorized user for all of the propulsion devices;

the starter switch includes an all-device start switch arranged to be operated by the operator to collectively start the engines in all of the propulsion devices;

the determining unit is arranged to determine as the start permission condition if an all-device start permission condition is met to collectively start the engines in all of the propulsion devices; and the stand-by unit is arranged to, when receiving an all-device start command from the all-device start switch, stand by until the authentication unit succeeds in authentication for all of the propulsion devices and information for determination of the all-device start permission condition is acquired from the propulsion device control unit.

5. The marine vessel control apparatus according to claim 4, wherein the stand-by unit is arranged to stand by until a predetermined amount of time passes after the all-device start switch is operated.

6. The marine vessel control apparatus according to claim 5, wherein the determining unit is arranged to, if any one of a plurality of predetermined conditions is met before the predetermined time passes, determine as the start permission condition whether a predetermined individual start permission condition is met to individually start the engine in a successfully authenticated one of the propulsion devices, the plurality of predetermined conditions including that the authentication unit does not succeed in authentication for all of the propulsion devices, that the information for determination of the all-device start permission condition is not acquired from the propulsion device control unit, and that the all-device start permission condition is not met.

7. A marine vessel control apparatus arranged and programmed to control a propulsion device including an engine and a propulsion device control unit, the marine vessel control apparatus comprising:

a starter switch arranged to be operated by an operator to start the engine; and a main control unit arranged and programmed to receive a start command from the starter switch and to communicate with the propulsion device control unit, the main control unit including:

a stand-by unit arranged to, when receiving the start command from the starter switch, stand by until information for determination of a predetermined start permission condition is acquired from the propulsion device control unit;

a determining unit arranged to, after the information for determination of the predetermined start permission condition is acquired, determine if the predetermined start permission condition is met; and an engine start command unit arranged to, if the predetermined start permission condition is met, provide an engine start command to the propulsion device control unit; wherein the propulsion device further includes an engine start holding circuit arranged to continue an engine starting operation independently of the operation of the propulsion device control unit for a predetermined period of time after the engine is started; and the propulsion device control unit includes a computer programmed to, if the engine start holding circuit continues the engine starting operation immediately after an initialization, perform an engine starting process independently of the engine start command from the main control unit.

8. A marine vessel propulsion system comprising:

a propulsion device including an engine and a propulsion device control unit; and the marine vessel control apparatus according to claim 4 arranged and programmed to control the propulsion device.

9. A marine vessel comprising:

a hull;

a propulsion device mounted on the hull and including an engine and a propulsion device control unit; and the marine vessel control apparatus according to claim 4 arranged and programmed to control the propulsion device.

10. A marine vessel propulsion system comprising:

a propulsion device including an engine and a propulsion device control unit; and the marine vessel control apparatus according to claim 7 arranged and programmed to control the propulsion device.

11. A marine vessel comprising:

a hull;

a propulsion device mounted on the hull and including an engine and a propulsion device control unit; and the marine vessel control apparatus according to claim 7 arranged and programmed to control the propulsion device.

12. The marine vessel according to claim 1, wherein the propulsion device further includes a clutch mechanism switchable between a connected state in which a driving force from the engine is transmitted to a propulsive force generation member, and a blocked state in which connection through a driving force transmission path from the engine to the propulsion force generation member is blocked;

the marine vessel further comprises an operation unit to be operated by an operator and arranged to generate a command signal to put the clutch mechanism into the connected state or the blocked state;

the main control unit receives the command signal from the operation unit; and the start permission condition includes that the operation unit outputs the command signal to put the clutch mechanism into the blocked state.

13. The marine vessel according to claim 1, wherein the propulsion device further includes a clutch mechanism switchable between a connected state in which a driving force from the engine is transmitted to a propulsive force generation member, and a blocked state in which connection through a driving force transmission path from the engine to the propulsion force generation member is blocked;

the propulsion device control unit detects the state of the clutch mechanism and sends the main control unit an information indicative of the state of the clutch mechanism; and the start permission condition includes that the clutch mechanism is in the blocked state.

14. The marine vessel according to claim 1, wherein the propulsion device control unit detects an engine speed of the engine and sends the main control unit an information indicative of the engine speed; and the start permission condition includes that the engine speed is not more than a predetermined speed.

15. The marine vessel according to claim 1, further comprising an operation unit to be operated by an operator for output control of the propulsion device, wherein the main control unit is installed in the operation unit.

16. The marine vessel according to claim 1, further comprising:

an operation unit including a lever to be operated by an operator within a positional range including a neutral position, and a lever position sensor that detects an operation position of the lever and generates a lever position signal; wherein the main control unit receives the lever position signal from the lever position sensor; and the start permission condition includes that the lever position signal indicates that the operation position of the lever is in the neutral position.

* * * * *